US006854246B2

(12) United States Patent
Savage et al.

(10) Patent No.: US 6,854,246 B2
(45) Date of Patent: Feb. 15, 2005

(54) BAG-IN-CONTAINER ASSEMBLY AND METHOD

(75) Inventors: Chester Savage, Irvine, CA (US); Rocklin Verespej, San Clemente, CA (US); Joseph C. Hsu, Irvine, CA (US); Robert Scholle, Irvine, CA (US)

(73) Assignee: Scholle Corporation, Irvine, CA (US)

( * ) Notice: Subject to any disclaimer, the term of this patent is extended or adjusted under 35 U.S.C. 154(b) by 0 days.

(21) Appl. No.: 10/461,238

(22) Filed: Jun. 13, 2003

(65) Prior Publication Data

US 2004/0016672 A1 Jan. 29, 2004

Related U.S. Application Data

(63) Continuation of application No. 09/736,976, filed on Dec. 14, 2000, now abandoned.
(60) Provisional application No. 60/170,662, filed on Dec. 14, 1999.

(51) Int. Cl.[7] ..... B65B 11/58
(52) U.S. Cl. ..... 53/449; 53/403; 53/405; 53/434; 53/467; 53/469; 53/471; 53/472
(58) Field of Search ..... 53/449, 403, 405, 53/408, 432, 434, 467, 469, 471, 472, 476, 485, 486, 173, 174, 175

(56) References Cited

U.S. PATENT DOCUMENTS

| | | | | |
|---|---|---|---|---|
| 1,517,978 A | * | 12/1924 | Giese | 220/62.18 |
| 4,054,161 A | * | 10/1977 | Alack | 141/12 |
| 4,635,814 A | * | 1/1987 | Jones | 220/495.05 |
| 4,925,055 A | * | 5/1990 | Robbins et al. | 220/495.06 |
| 5,046,634 A | * | 9/1991 | McFarlin et al. | 53/457 |
| 5,794,670 A | * | 8/1998 | LaFleur | 141/314 |
| 6,536,620 B2 | * | 3/2003 | Moran | 215/396 |

* cited by examiner

*Primary Examiner*—Scott A. Smith
*Assistant Examiner*—Brian Nash
(74) *Attorney, Agent, or Firm*—King & Jovanovic, PLC

(57) ABSTRACT

A flexible bag is positioned in a rigid container, such as a fifty-five gallon drum, and the bag is filled through its spout with flowable product, such as tomato paste. The bag is then expanded in the container to be substantially rigid and thereby reduce film movement and resultant flex cracking. A lid is sealed onto the container and a vacuum drawn from between the bag and the container, to, in turn, expand the bag. Gas volume needs to be present in the bag before the vacuum is applied so that the gas in the bag can expand from the vacuum on its outside. Once expanded, the container can be shipped.

19 Claims, 23 Drawing Sheets

BAG-IN-CONTAINER ASSEMBLY AND METHOD

CROSS REFERENCE TO RELATED APPLICATIONS

This application is a continuation of application Ser. No. 09/736,976 filed 14 Dec. 2000, now abandoned. This application claims the benefit of the U.S. Provisional Application No. 60/170,662, filed Dec. 14, 1999, and whose entire contents are hereby incorporated by reference.

FIELD OF THE INVENTION

The present invention relates to flexible bags positioned in a rigid container, and more particularly to expanding the flexible bag to reduce film movement and resultant flex cracking.

BACKGROUND OF THE INVENTION

Flowable products are often packaged in flexible bags, which are held in large steel drums sealed closed with their lids. This allows large quantities of the flowable products to be securely stored and transported to another location where the products can be removed, further processed and repackaged for the consumer. As an example, the flowable product can be a liquid or a particulate-containing liquid, such as juice concentrates (e.g., orange juice), fruit cocktail, yogurt and concentrated tomato paste. As a more specific example, for concentrated tomato paste, the large drum with the bag of tomato paste stored therein is transported to the customer's processing plant, the lid removed, the bag removed, an uncapping mechanism removes the bag cap, the paste is pumped out of the bag, processed into spaghetti sauce, repackaged (in bottles for example) and delivered to the retail stores.

During the transport of the drums with liquid-filled bags therein, the liquid tends to slosh back and forth in the bags. To minimize this sloshing action, dunnage (filler) is positioned in the container at the top of the bags to fill a head space region. The dunnage can be bubble wrap, cut-to-fit foam pieces, spray-type foam, flexible "peanuts," or preformed conglomerate sponge pieces. The dunnage, while reducing the movement of the bag, does not prevent the wrinkling and flex cracking at the top of the bag, along the liquid "shoreline" in the bag. The flex cracking can cause pin hole breaks in the bag resulting in product leakage and/or possible product contamination. Furthermore, significant labor and material costs may be incurred when filling the container with dunnage. When using cut-to-fit foam as dunnage, the foam piece may require trimming for proper fitment into the head space region. Generally, the foam piece is oversized to reduce movement of the bag within the container so that an operator is required, usually with difficulty, to compress the foam piece before securing the lid onto the container.

Examples of the prior art are the following U.S. Pat. No. 3,169,690 (Scholle), U.S. Pat. No. 4,635,814 (Jones), U.S. Pat. No. 5,046,634 (McFarlin, et al.), U.S. Pat. No. 5,454,407 (Huja et al.) and U.S. Pat. No. 5,806,572 (Voller). The entire contents of each of these patents are hereby incorporated by reference.

SUMMARY OF THE INVENTION

Thus, directed to reducing or eliminating the above-mentioned "flex cracking" problem in the prior art bags, an improved flexible bag-in-container assembly and method are herein disclosed. The assembly includes a container, such as a fifty-five gallon steel drum with a lid sealable thereto, a flexible bag stored in the container and filled with a flowable liquid product and expansion means for causing the bag in the container to expand to a more rigid state and thereby reduce the wrinkling in the upper portion of the bag. The volume of the bag can be either larger or smaller than that of the container.

One expansion means of the present invention is to fill a bag (preferably when in the container) with the flowable (liquid) product, seal the container closed, and then apply a vacuum in the container. Gas (e.g., one to five liters in a fifty-five gallon bag) will need to be injected in the bag before (or simultaneously with) the vacuum is applied so that the bag can be pulled and expanded. The gas is preferably injected into the bag before the lid is sealed onto the container or after it has been sealed through a gas pressure valve extending through an opening in the top of the lid. The valve can be at the top of the spout fitment which is sealed to the flexible bag material. The vacuum (due to the lower pressure outside the bag than inside) causes the bag to expand thereby reducing or eliminating bag wrinkles and/or folds.

Another expansion means is to inject gas pressure in the bag causing the bag to expand in the container. The pressure can be applied after the lid has been applied to the container in which case a relief valve is provided in the container (preferably the lid thereof to allow the release of gas pressure in the container when the bag is inflated. (Or less preferably a vacuum can be applied to the container.) Alternatively, the bag can be inflated and then the lid forced down and secured to the container. The gas pressure causes the bag to expand, thereby reducing or eliminating bag wrinkles and/or folds.

In either of the two above-discussed expansion means the bag can have a volume greater than the volume of the container in which case the bag after the expansion process will fill the container, and seat itself in the container. When the bag volume is larger than the container volume and is inflated by internal pressure or external vacuum, the bag makes contact with the rigid container and flex cracking is reduced. In other words, the bag film is thereby locked against the inside of the container and the bag becomes a skin on the inside of the container and does not move when the liquid sloshes back and forth. An option thereof is to include an adhesive on the lid to hold the bag in an expanded state. Alternatively, the bag can have a volume less than the volume of the container in which case the bag after the expansion process will have a rounded or bulging top, a generally rigid stretched dome, lacking folds, and also reducing flex cracking.

Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS OF THE INVENTION

Detailed descriptions of the preferred embodiments are provided herein. The general concept of each embodiment is that a flexible bag is positioned in a durable storage and transport container. It is to be understood, however, that the present invention may be embodied in various forms. Therefore, specific details disclosed herein are not to be interpreted as limiting, but rather as a basis for the claims and as a representative for teaching one skilled in the art to employ the present invention in virtually any appropriately detailed system, structure or manner.

Referring to FIGS. 1–14, embodiments of the present invention are illustrated. A flexible bag 100 is positioned in a durable storage and transport container 104. The flexible bag 100 is filled with a flowable product, such as the particulate-containing liquid products discussed above. The bag 100 is then expanded to minimize or eliminate the wrinkling and/or folding occurring on the upper top thereof. Two primary methods of inflating or expanding the upper portion of the flexible bag 100 are disclosed herein.

Figure 6:
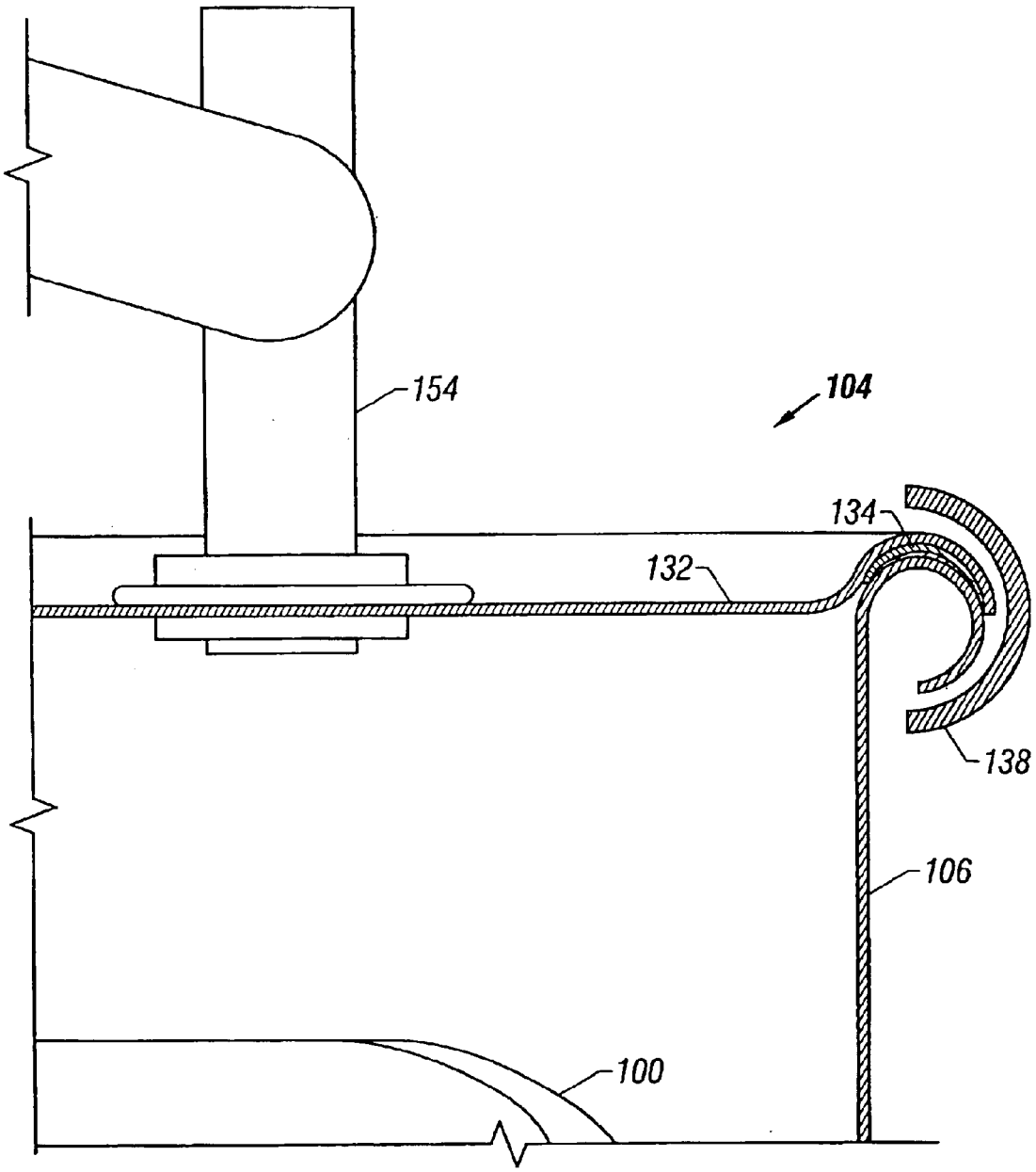
FIG. 6 is an enlarged view of the right portion of FIG. 4.

A first method is to pressurize the bag 100. After the bag 100 has been filled with the liquid product, a gas may be injected through a valve 120 into the bag 100. The bag 100 is maintained at a pressurized state by closing the valve 120. An inert gas such as nitrogen is typically used for applications where flowable products are subject to oxidation. However, for goods not subject to oxidation, such as for many chemicals, the injected gas can be simply compressed air. The injected gas pressure can be one to five psi, and the gas volume can be one to five liters. Referring to the drawings, the container 104 is illustrated as a fifty-five gallon steel drum having a body member 106 and a lid 132. It is noted that the present invention is not limited to only drum type containers but to any form of container known to one skilled in the art. The lid 132 is secured to the body member 106 in a conventional manner using a lid ring 138 and gasket 134, as best shown in FIG. 6. In other words, a semi-circular band catches the upper side of the lid 132 and the underside lip of the body member 106, and the band runs around the lip-rim and is locked down with a screw which extends through two threaded eyelets. The band pinches the top and bottom together. Thus, the lid-ring 138 tightens the lid 132 to the body member 106 when locked down with a bolt, and it covers the entire three hundred and sixty degrees of rotation around the rim.

Figure 5:
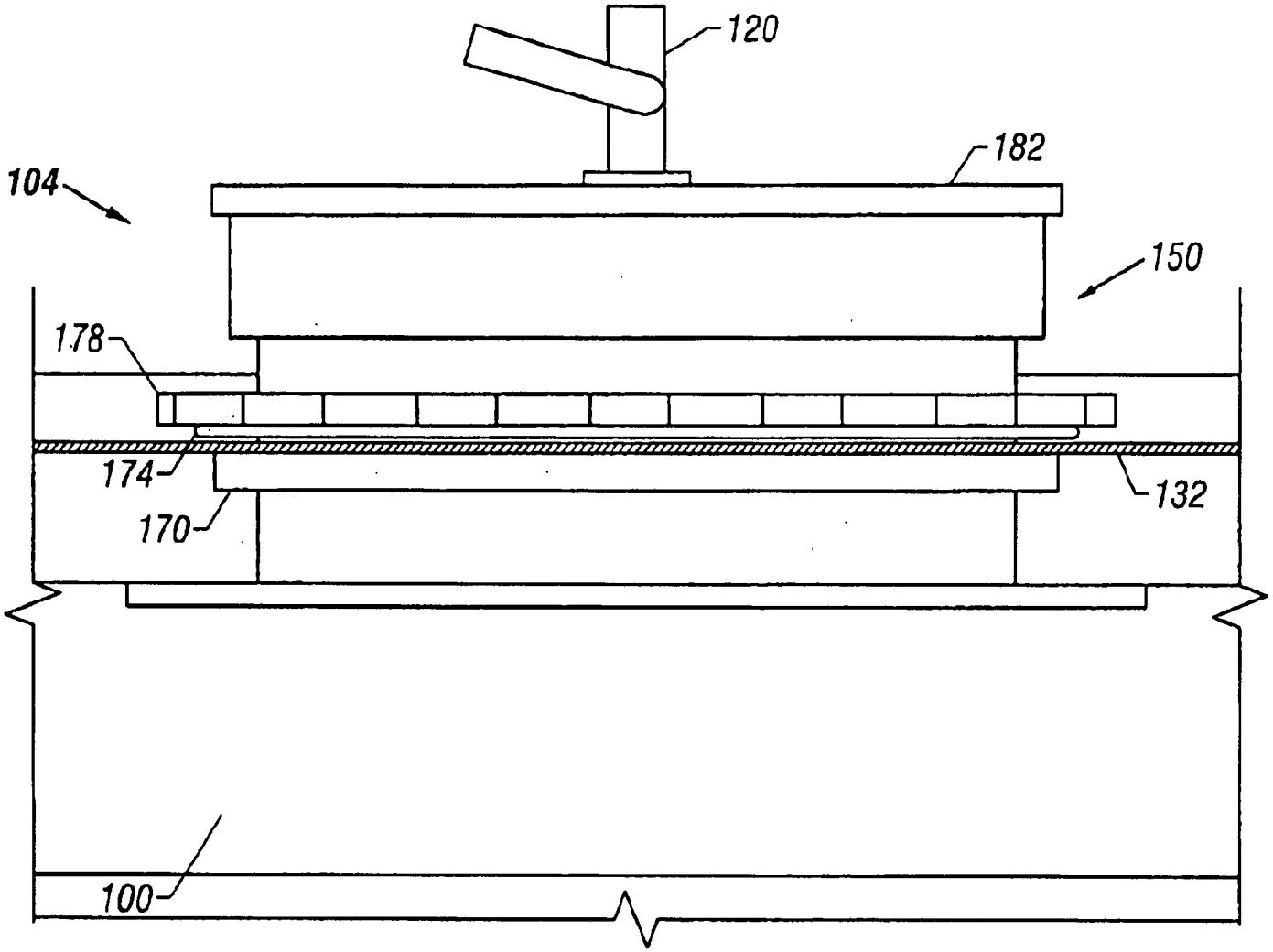
FIG. 5 is an enlarged view of the left portion of FIG. 4.
Figure 14:
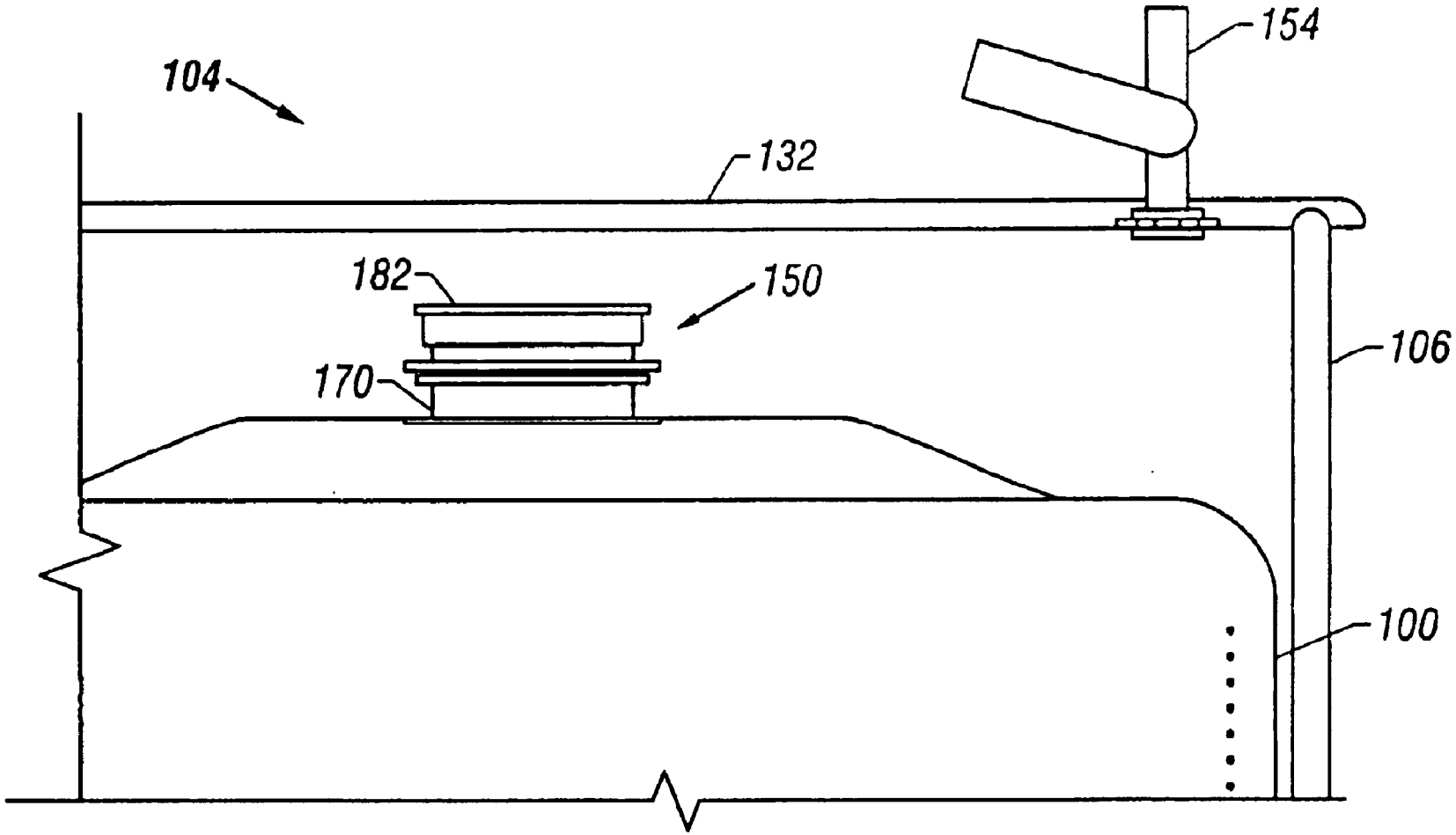
FIG. 14 is an enlarged view of the top right portion of the assembly of the system of FIG. 11.
Figure 15:
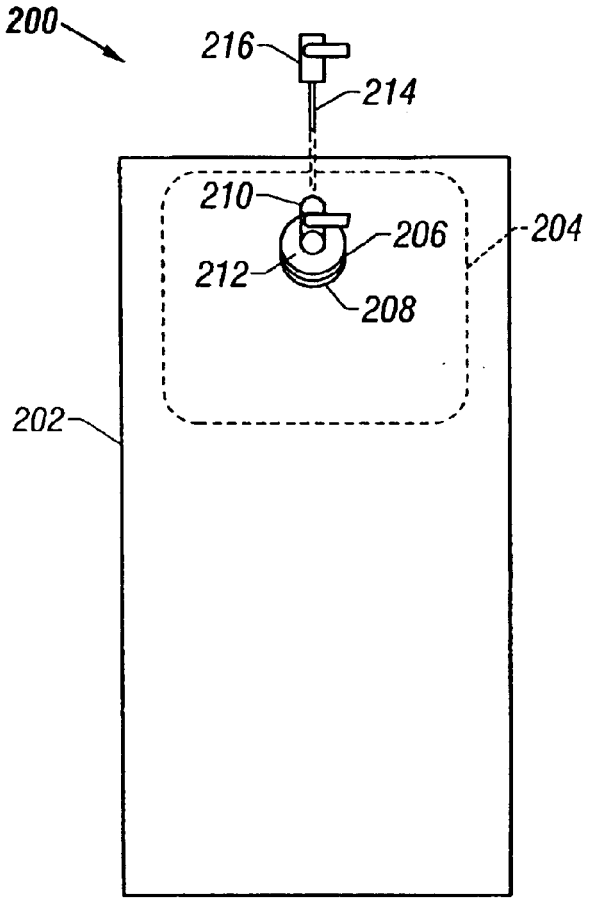
FIG. 15 is a side elevational view of an alternative embodiment of a flexible bag of the present invention.
Figure 16:
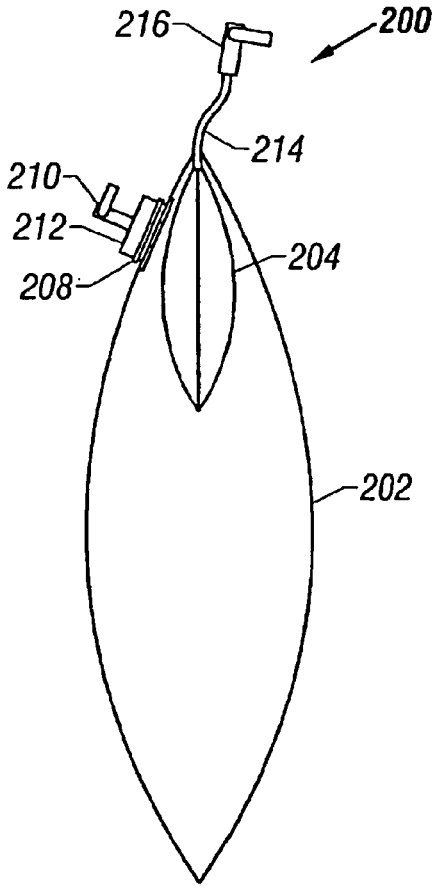
FIG. 16 is a cross sectional view of the flexible bag of FIG. 15.
Figure 17:
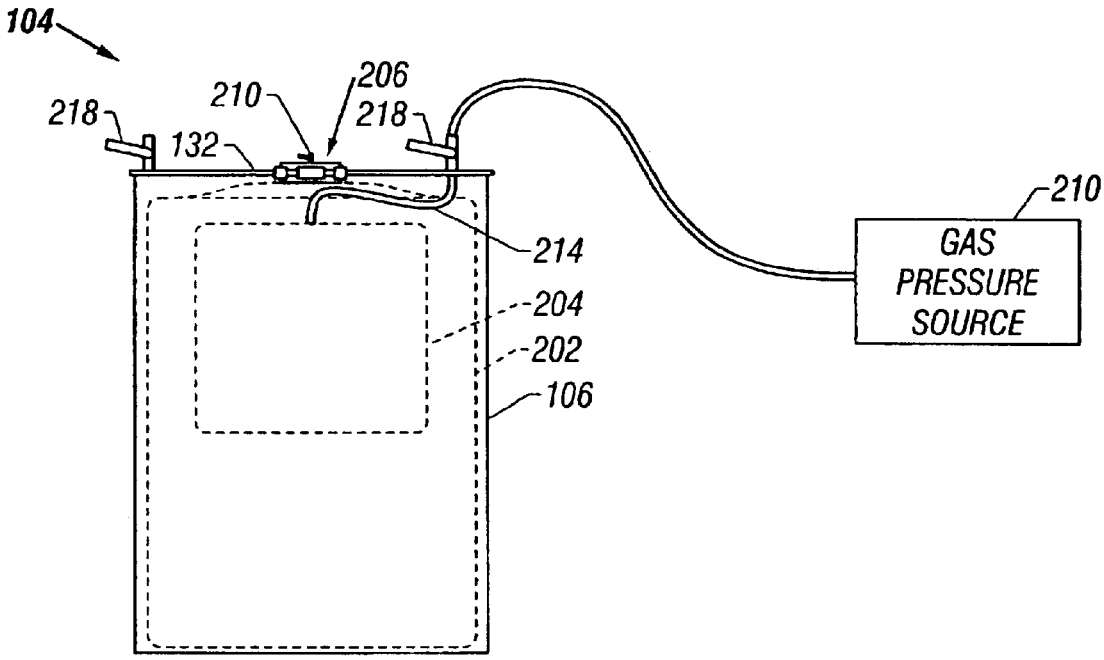
FIG. 17 is a side elevational view of a storage and transport system of FIG. 15.
Figure 18:
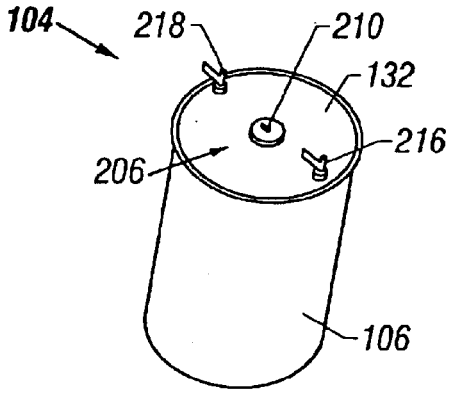
FIG. 18 is a top perspective view of the bag-in-container assembly of the system of FIG. 17.
Figure 19:
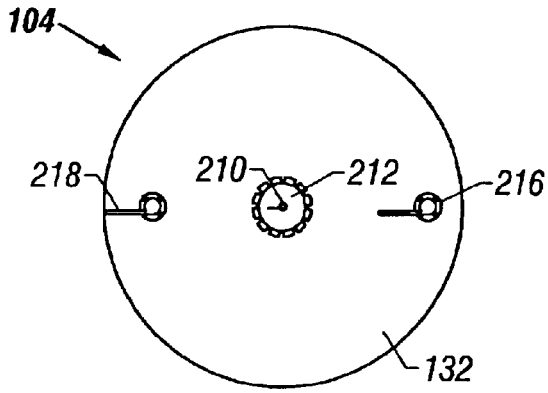
FIG. 19 is an enlarged top plan view of the assembly of FIG. 18.
Figure 20:
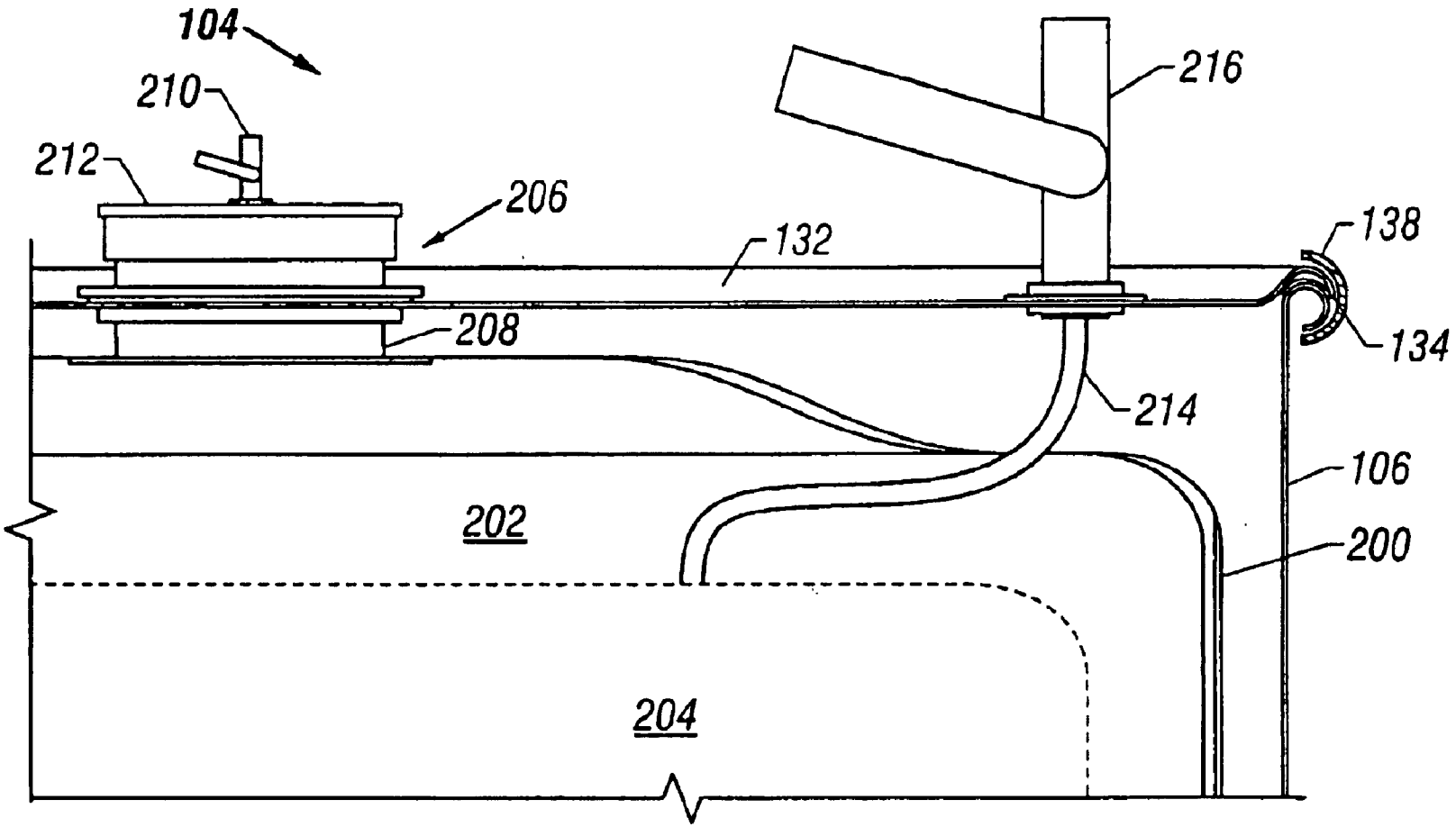
FIG. 20 is an enlarged elevational view of the upper right corner of the assembly of the system of FIG. 18.
Figure 21:
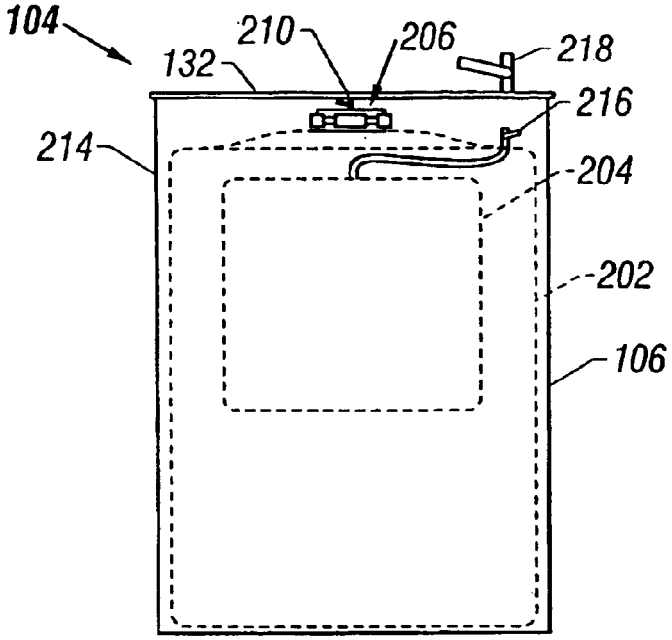
FIG. 21 is a side elevational view of an alternative storage and transport system of FIG. 15.
Figure 22:
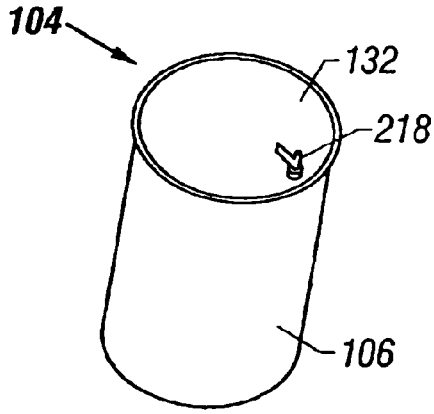
FIG. 22 is a top perspective view of the bag-in-container assembly of the system of FIG. 21.
Figure 23:
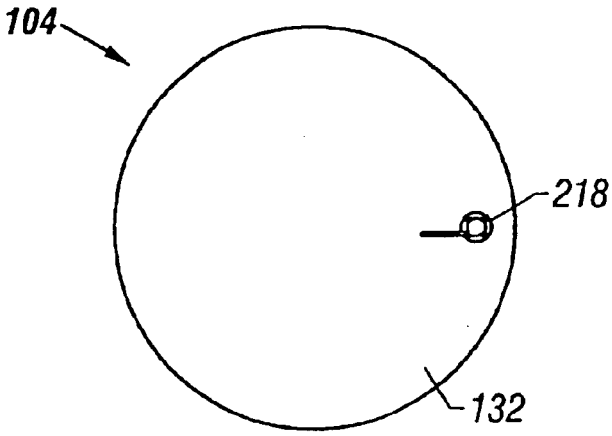
FIG. 23 is a top plan view of the assembly of FIG. 22.
Figure 24:
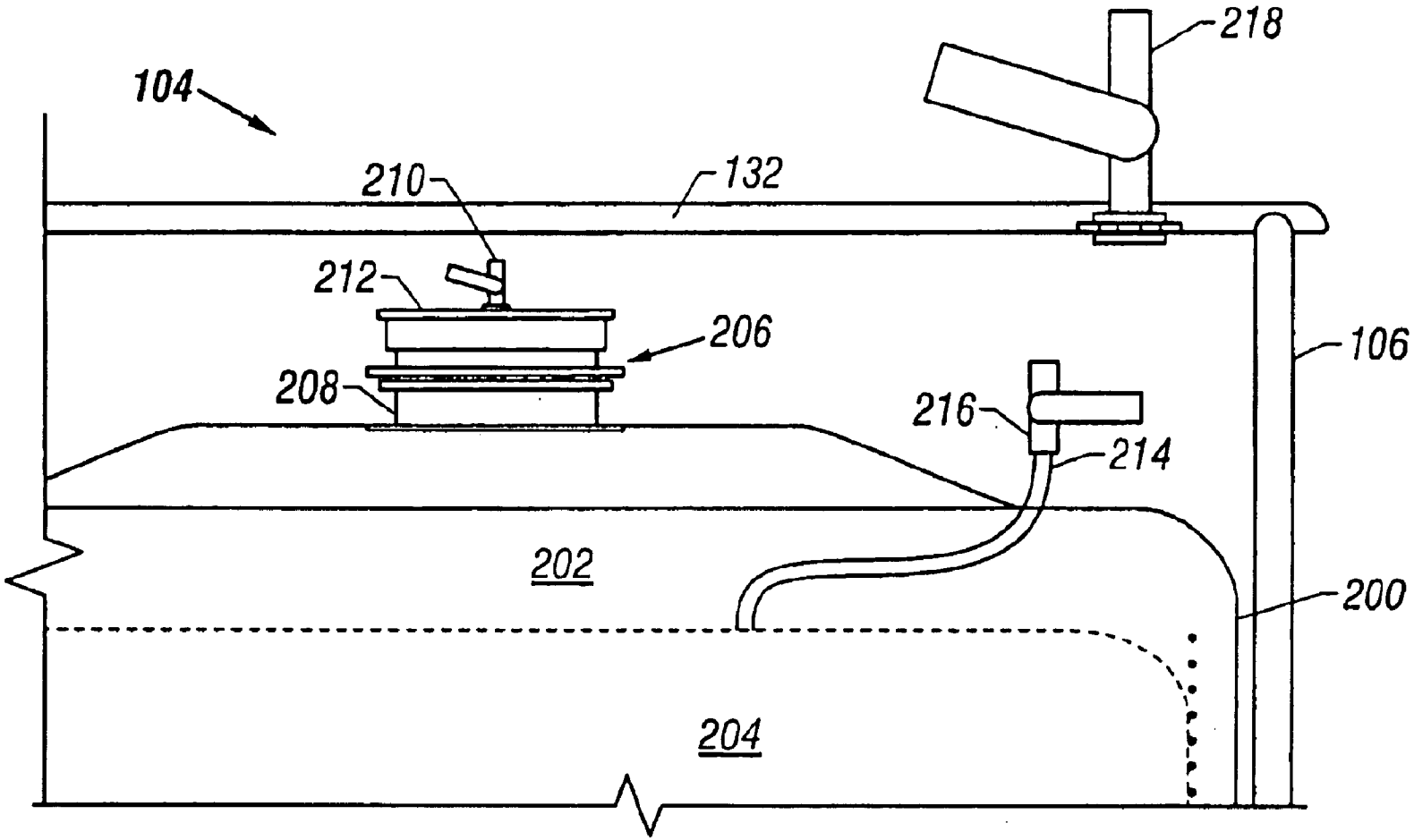
FIG. 24 is an enlarged view of the top right portion of the assembly of FIG. 22.
Figure 25:
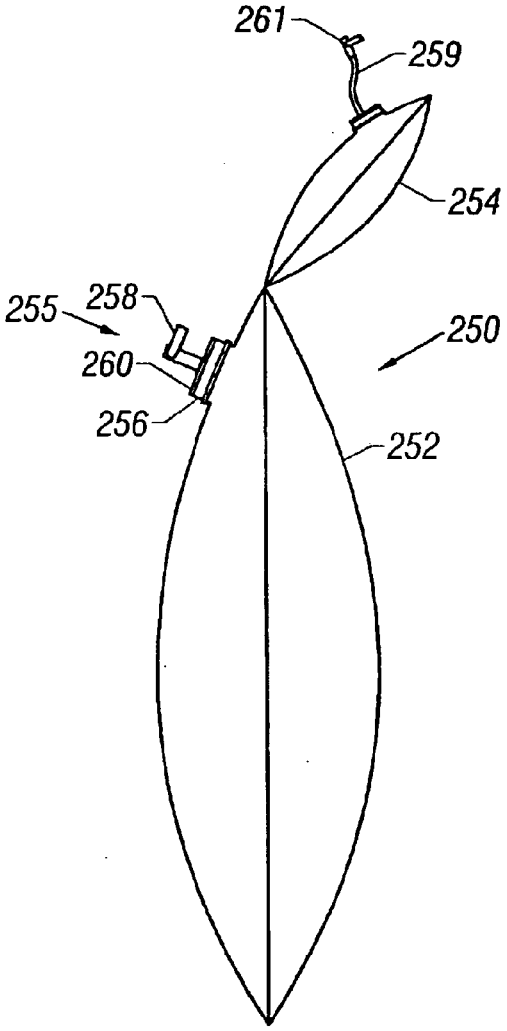
FIG. 25 is a side elevational view an alternative embodiment of a flexible bag of the present invention.
Figure 26:
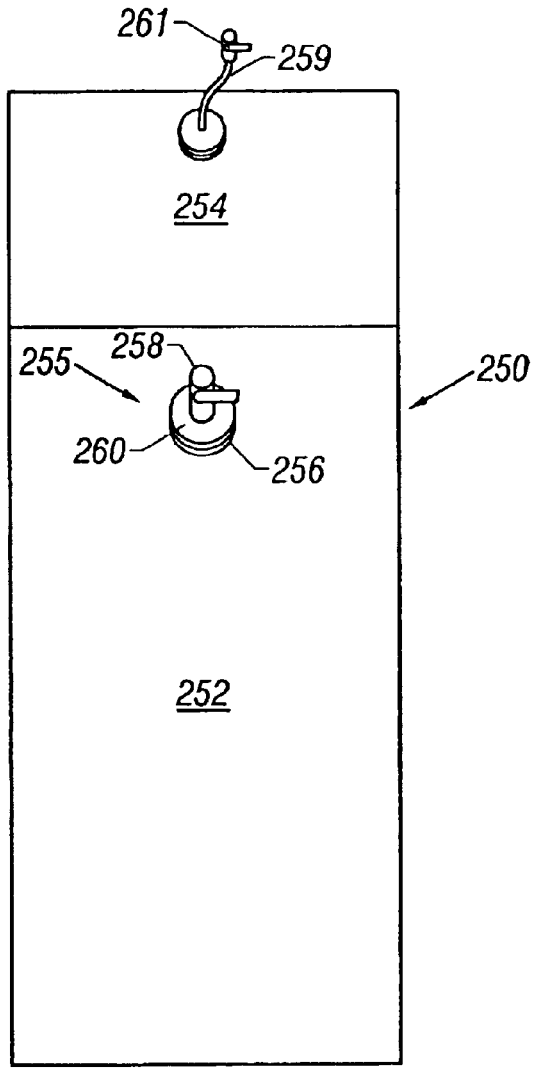
FIG. 26 is a cross sectional view of the flexible bag of FIG. 25.
Figure 27:
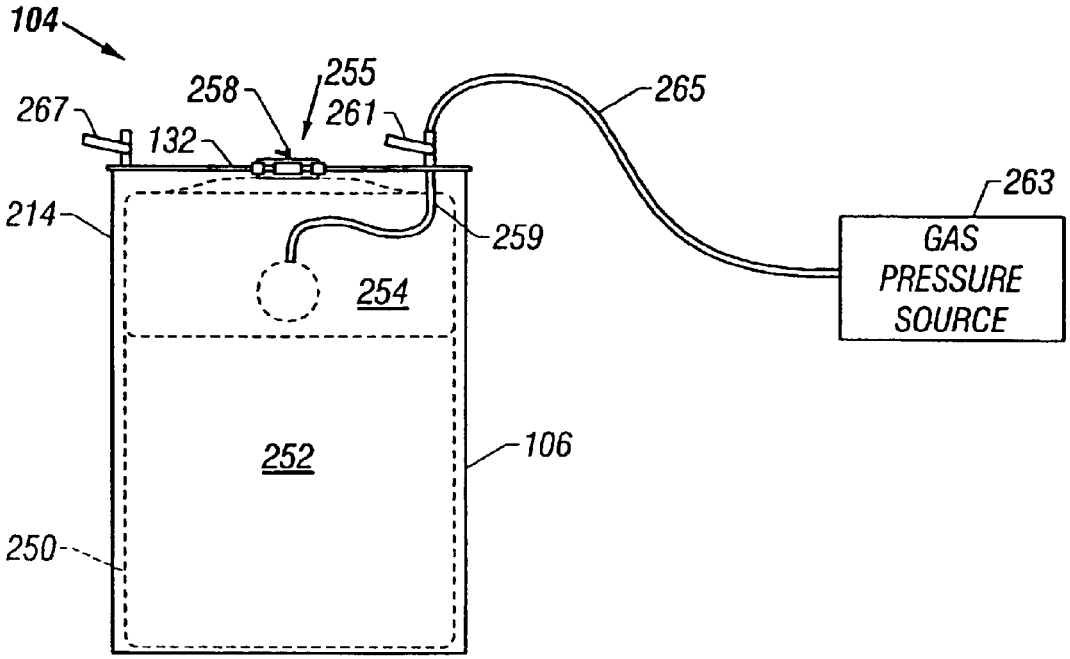
FIG. 27 is a side elevational view of a storage and transport system of FIG. 25.
Figure 28:
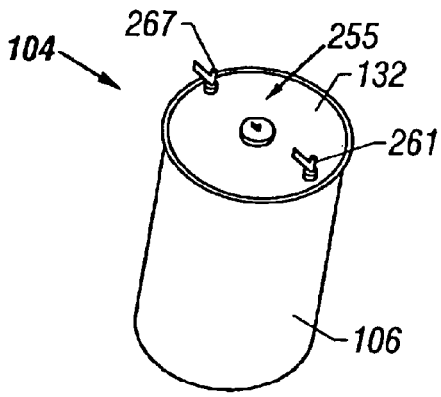
FIG. 28 is a top perspective view of the bag-in-container assembly of the system of FIG. 27.
Figure 29:
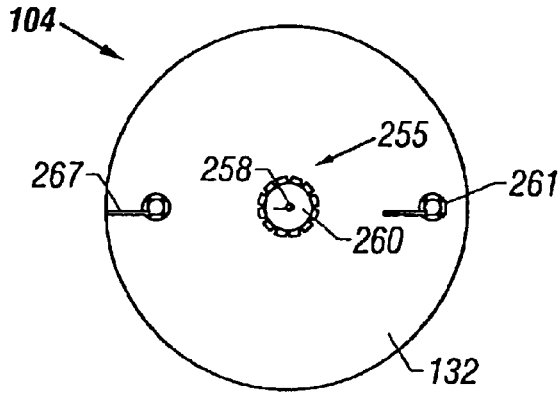
FIG. 29 is an enlarged top plan view of the assembly of FIG. 28.
Figure 30:
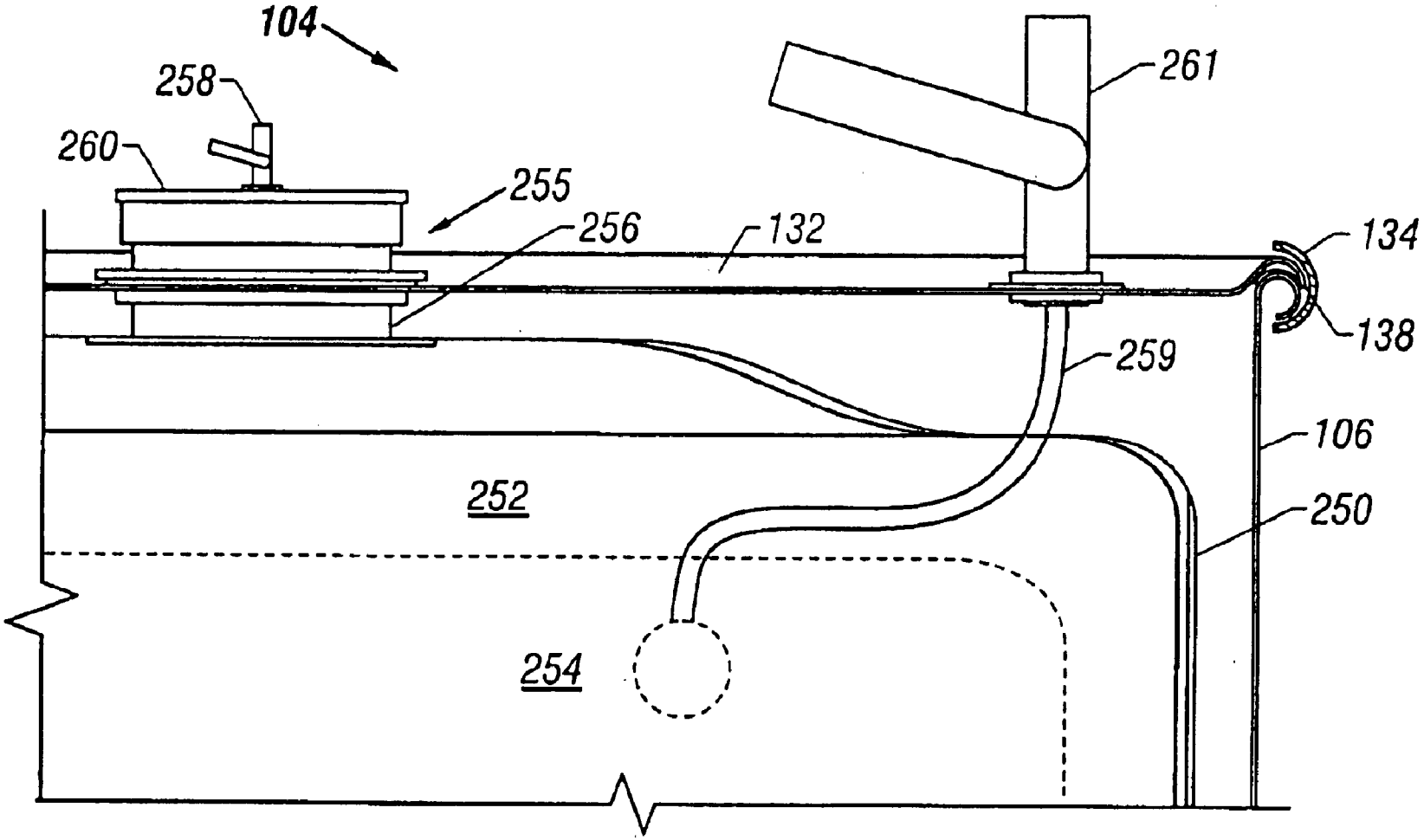
FIG. 30 is an enlarged elevational view of the upper right corner of the assembly of the system of FIG. 28.
Figure 31:
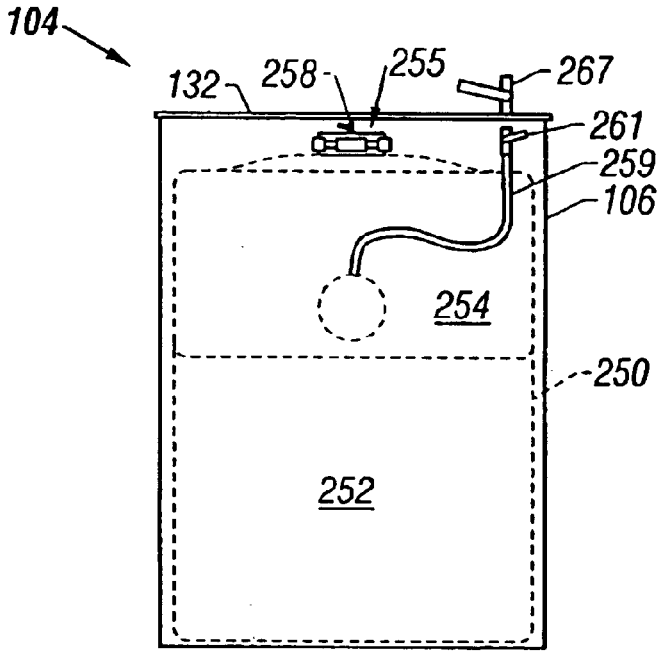
FIG. 31 is a side elevational view of an alternative storage and transport system of FIG. 25.
Figure 32:
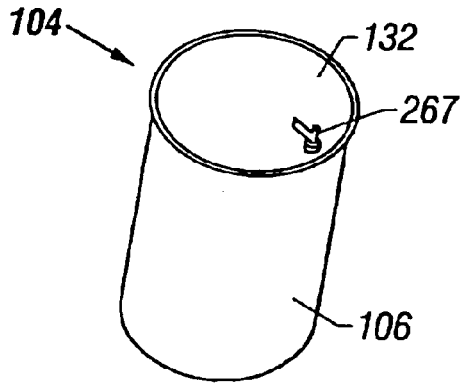
FIG. 32 is a top perspective view of the bag-in-container assembly of the system of FIG. 31.
Figure 33:
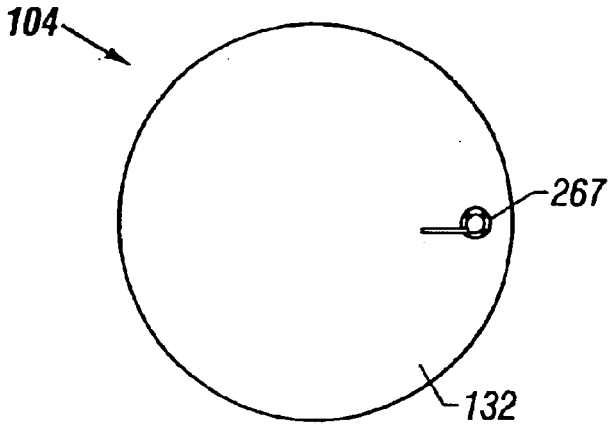
FIG. 33 is a top plan view of the assembly of FIG. 32.
Figure 34:
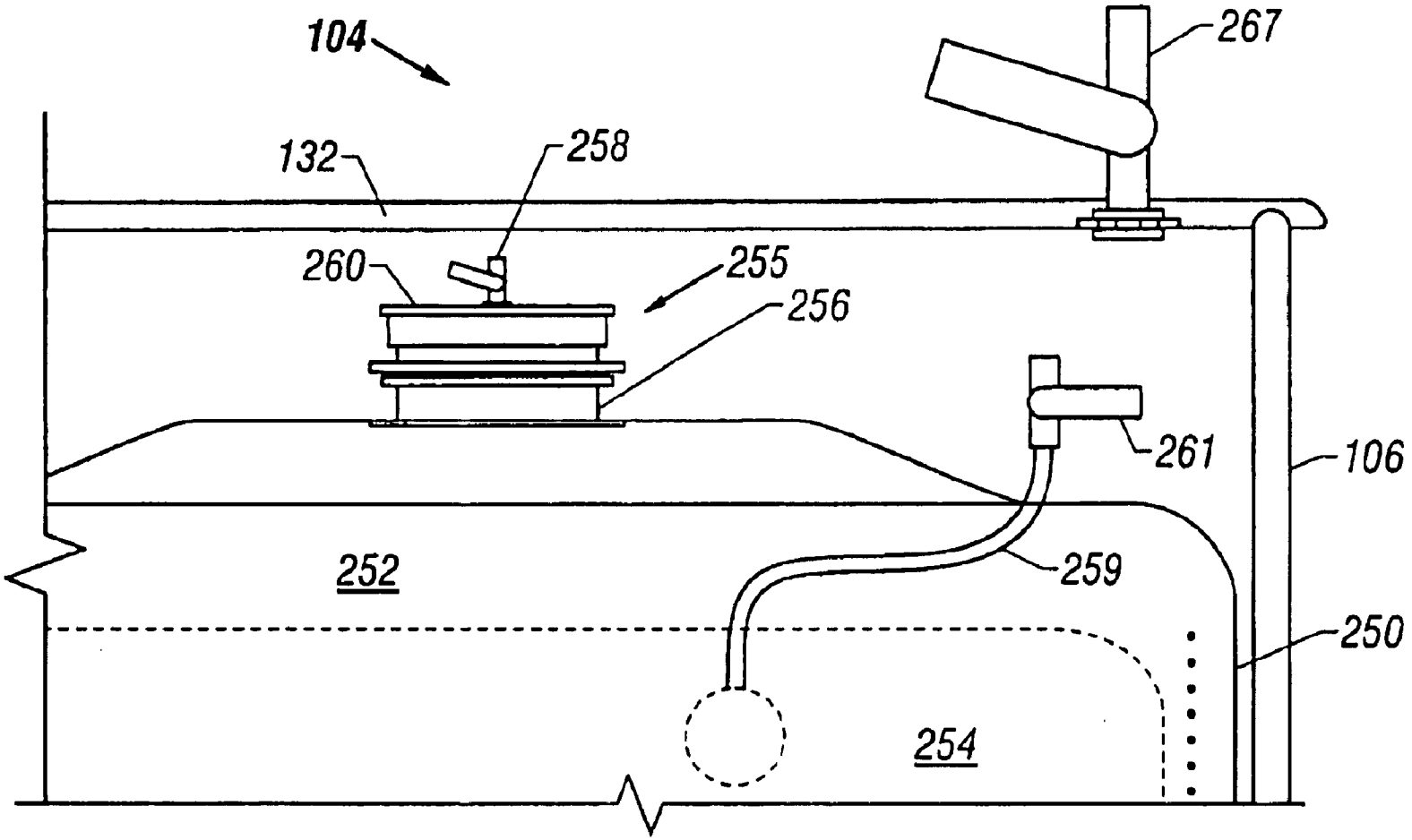
FIG. 34 is an enlarged view of the top right portion of the assembly of FIG. 32.
Figure 36:
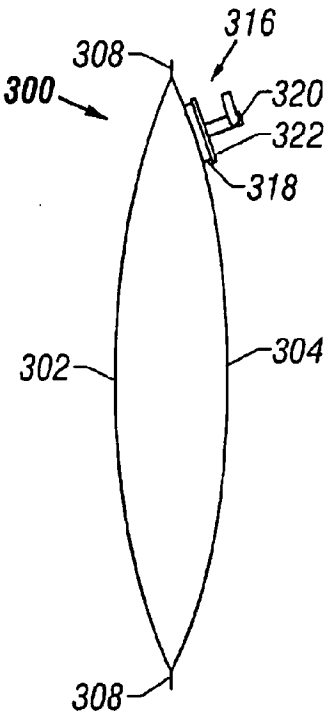
FIG. 36 is a cross sectional view of the flexible bags of FIGS. 35A and 35B.

The gas can be injected into the bag 100 either before the lid 132 has been sealed on to the body member 106 or after it has been sealed on to the body member 106. If the gas is injected before or if it is injected after the lid 132 is sealed, then the valve 120 can be provided to extend outwardly through the fitment (spout/cap/bag assembly shown generally at 150) and as best shown in FIG. 5. The valve is attached to a gas pressure source 152 as shown generically in FIG. 1. The gas pressure source 152 can, for example, be simply a connection to a pressure air line. Alternatively, the gas pressure source 152 can be a gas pressure pump. When the bag 100 is filled with pressurized gas with the lid 132 sealed closed to the body member 106, a vacuum/vent valve 154 for releasing the pressure in the container 104 surrounding or on top of the bag 100 should be provided. The vacuum/vent valve 154 can be a relief valve as best shown in FIG. 14, and the relief valve can be automatically or manually actuated. Alternatively, and less preferably the vacuum/vent valve 154 can be a vacuum valve connected to a vacuum source, and the vacuum source is shown generically in FIG. 1 at 160. The vacuum source 160 can be a standard vacuum cleaner with a regulator, which may pull twenty inches of mercury, or it may be a one horsepower gas or electric vacuum pump or a venturi vacuum pump. This will be described in greater detail with respect to the second method of providing the expansion mechanism for the flexible bag 100.

Figure 1:
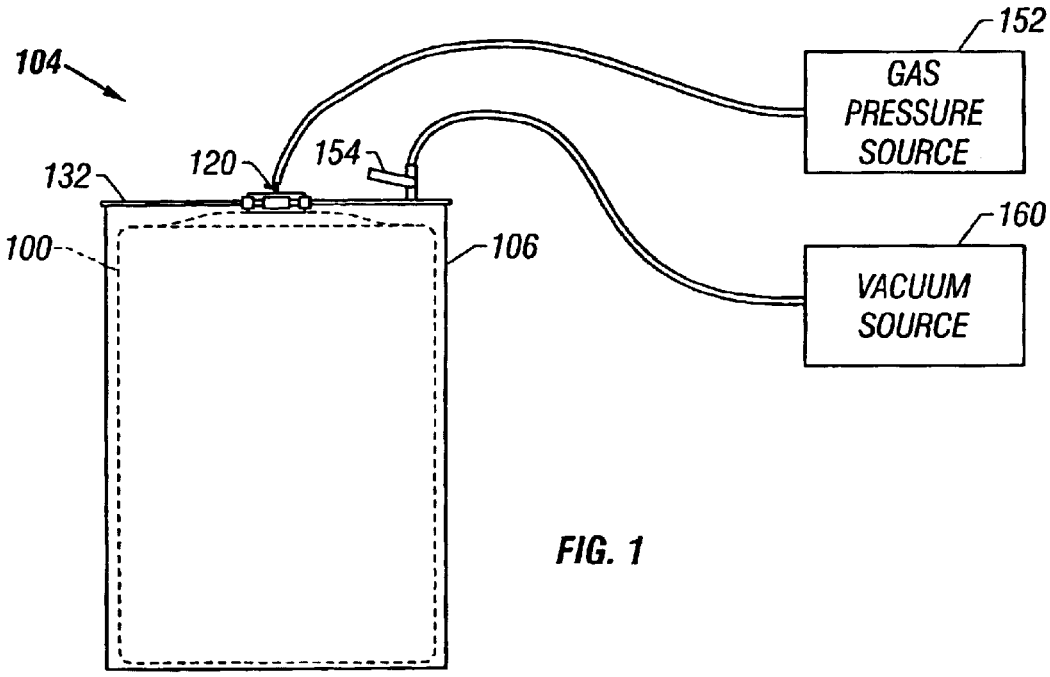
FIG. 1 is a side elevational view of a first storage and transport system of the present invention.
Figure 2:
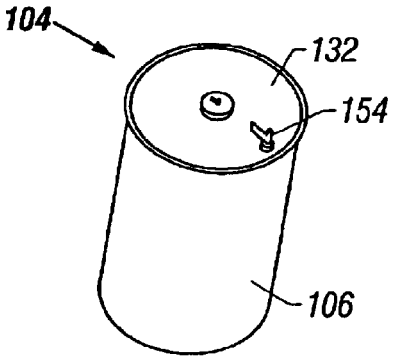
FIG. 2 is a top perspective view of the bag-in-container assembly of the system of FIG. 1.
Figure 3:
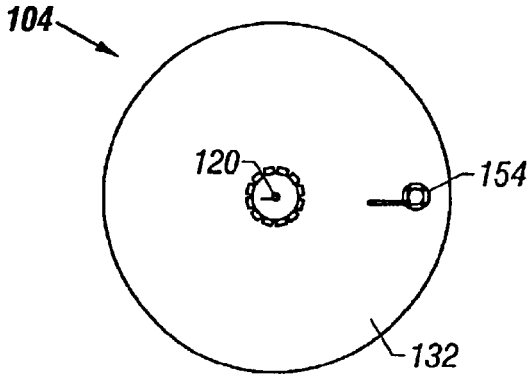
FIG. 3 is an enlarged top plan view of the assembly of FIG. 2.
Figure 7:
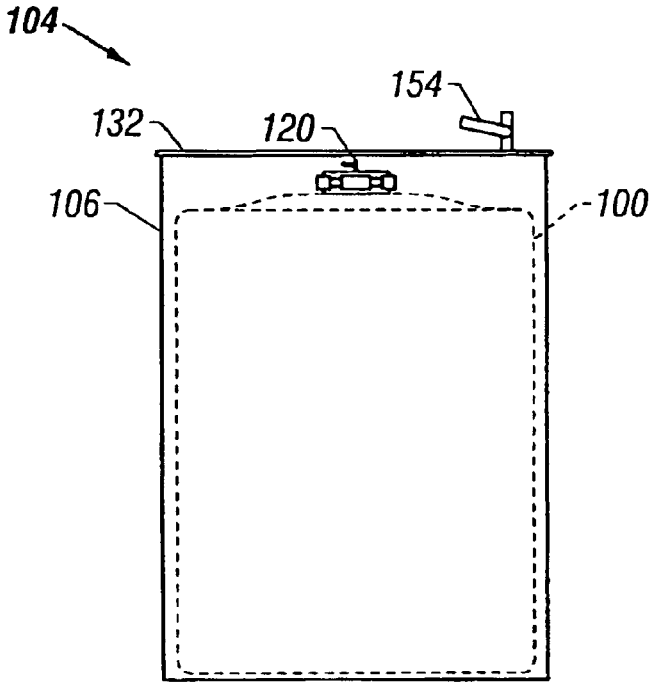
FIG. 7 is a side elevational view of a second storage and transport system of the present invention.
Figure 8:
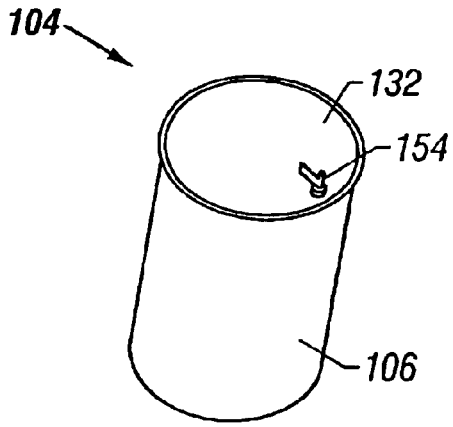
FIG. 8 is a top perspective view of the bag-in-container assembly of the system of FIG. 7.
Figure 9:
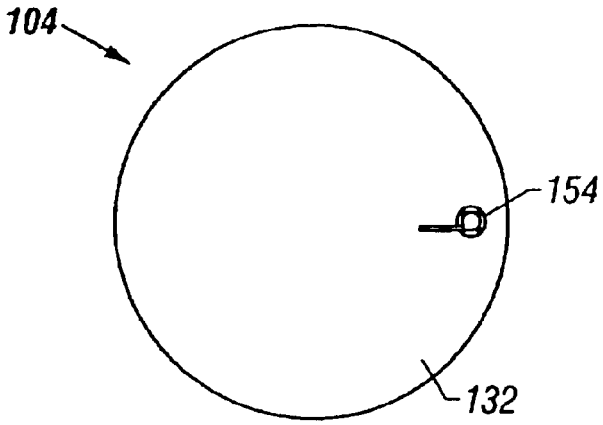
FIG. 9 is a top plan view of the assembly of FIG. 8.
Figure 10:
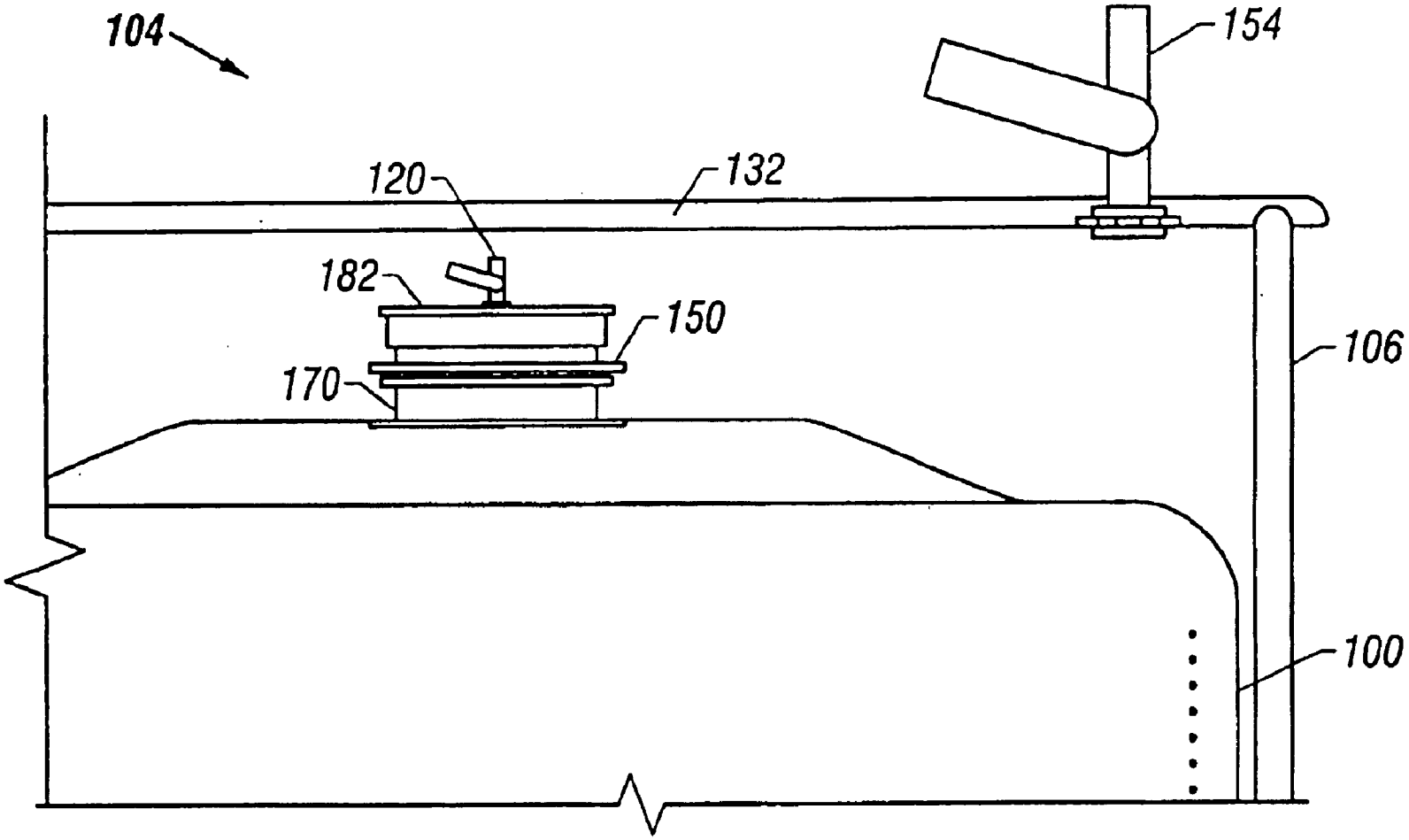
FIG. 10 is an enlarged view of the top right portion of the assembly of FIG. 7.
Figure 11:
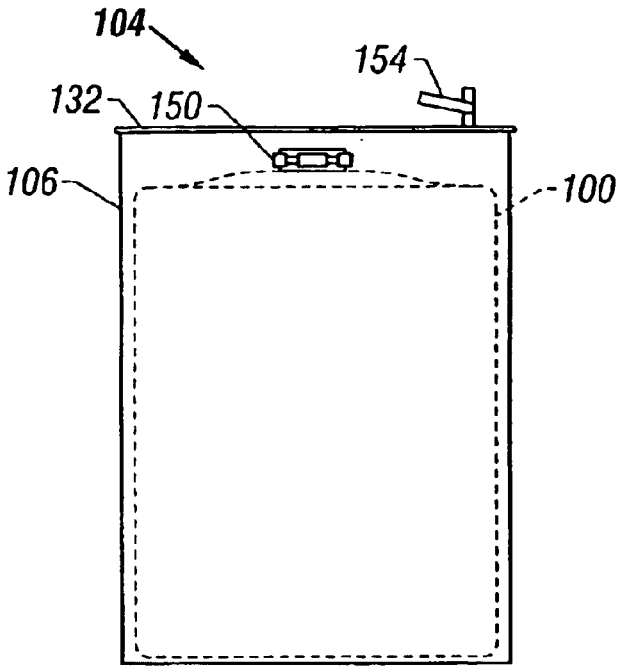
FIG. 11 is a side elevational view of a third storage and transport system of the present invention.
Figure 12:
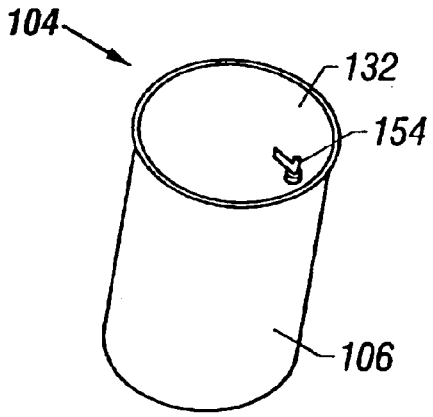
FIG. 12 is a top perspective view of the bag-in-container assembly of the system of FIG. 11.
Figure 13:
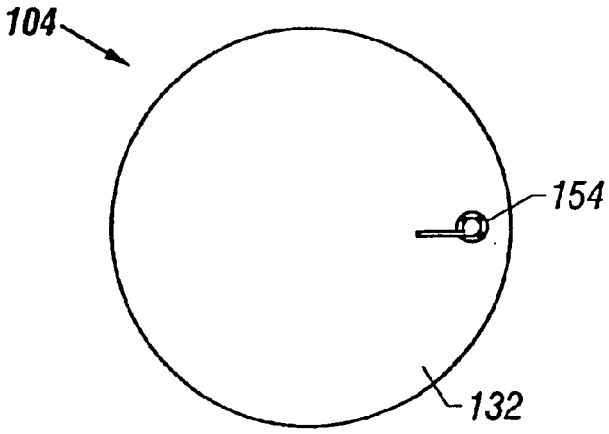
FIG. 13 is a top plan view of the assembly of FIG. 12.

Alternatively, the bag 100 can be filled with pressurized gas before the lid 132 is attached to the body member 106 as shown in FIGS. 7 and 10. In this embodiment, a valve may be attached to the top of the fitment which is similar to the gas pressure valve 120. The gas pressure valve 120 may be simply attached to a gas pressure source such as shown in FIG. 1 at 152. After the desired additional air pressure has been injected into the bag 100, such as a pressure from one to five psi, the gas pressure valve 120 is closed. The lid 132 is then fitted onto the top of the body member 106, as shown in FIGS. 10 and 14. This may require a little pressure to push the bag 100 down and against any air pressure in the container 104 surrounding the bag 100. A relief valve or a vacuum valve such as shown at 154 in the lid 132 can be provided to release the pressure at the top of the container 104 so the lid 132 can be fitted securely. While the vacuum/vent valve 154 has been shown in the lid 132, it is also within the scope of the invention to mount the vacuum/vent valve in the body member 106 of the container 104.

Figure 4:
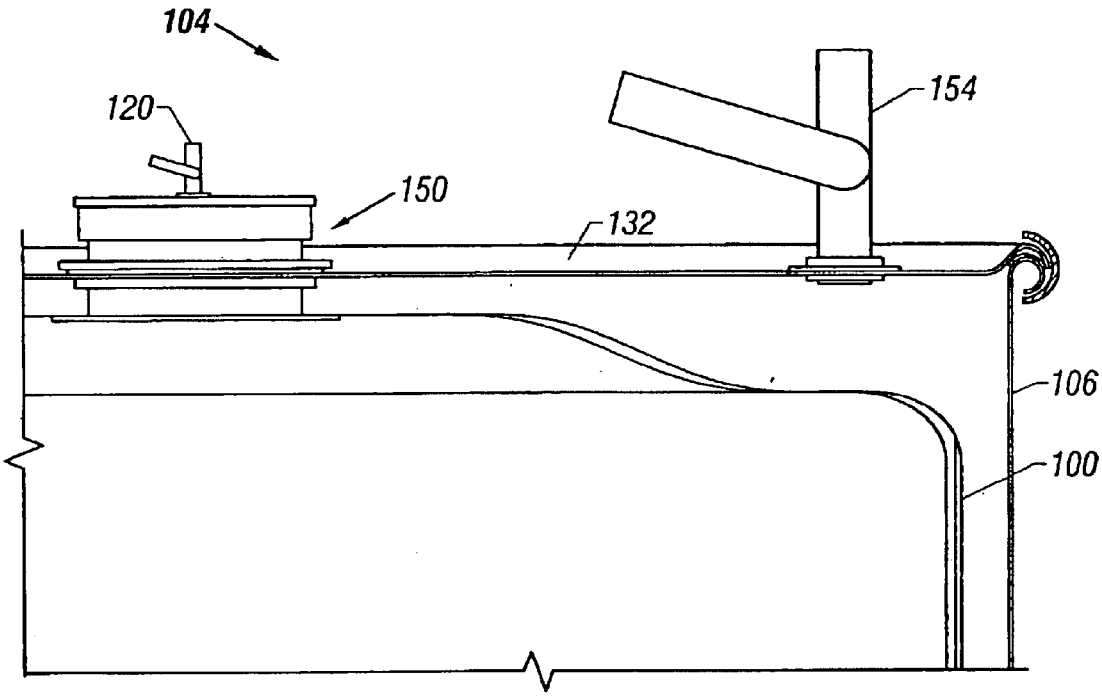
FIG. 4 is an enlarged elevational view of the upper right corner of the assembly of the system of FIG. 1.

The arrangement shown in FIGS. 4 and 5 can be used when the gas pressure valve 120 extends through the lid 132. Referring thereto it is seen that the different fitment components are illustrated including a spout flange 170, gasket 174, lock nut 178, and cap 182 mounted relative to the lid 132.

A second means of expanding or inflating the flexible bag 100 so as to reduce primarily film movement and secondarily wrinkling and thereby concomitant flex cracking is to apply a vacuum within the container 104 and around the bag 100. The vacuum can be applied through the vacuum/vent valve 154. In the embodiment shown in FIG. 11, a pressure valve is not shown for injecting gas into the bag 100 because there is no need to inject a pressurized gas to expand the bag 100. The bag 100 is expanded by applying a vacuum to the container 104 to create a pressure differential which is internal and external to the bag 100. For this embodiment, it is still necessary to have some air in the bag 100 so that the bag 100 can expand as a pressure differential is created from the vacuum, wherein the air in the bag 100 expands as a vacuum is formed in the container 104. Air or other inert gas can be injected by the automatic filling system when the cap (182) is off, that is, using the filling system with a secondary gas valve. Alternatively, the spout (170) can be pulled up slightly to draw air into the bag 100. If desired, pressurized gas may be injected into the bag in conjunction with forming a vacuum in the container. In this case, the injected gas pressure can be one to five psi, and the gas volume can be one to five liters.

It is contemplated that the first method of expanding the bag by injecting pressurized gas is preferable in applications where the container comprises gas permeable materials such as drums formed from cardboard, large crates having a plurality of openings, and smaller boxes formed from cardboard (i.e. 5 gallon wine-in-box containers). For aseptic applications and goods subject to oxidation, the second method of expanding the bag by forming a vacuum within the container is preferable.

The flexible bag 100 can be generally any type which is commercially available including single ply made of nylon and ethylene vinyl alcohol co-extrusion or complex polyethylene mixture or a polyethylene-polyester-polyethylene laminate construction. The fitment 150 or spout preferably has a material and construction so that it can be heat sealed to the bag material.

The bag 100 itself can have a volume slightly larger than the volume of the container 104 so that it entirely fills the container when expanded. Even though there may be some small wrinkles in the material, the liquid inside of the bag 100 will not move the wrinkles when impacting it and thereby cause flex cracking. An alternative embodiment is to have the volume of the bag 100 slightly smaller than that of the container 104, whereby when the bag is expanded it will be taut.

A preferred embodiment herein is to have the container 104 be a fifty-five gallon steel drum such as is known in the prior art and as illustrated herein. However, this invention can be used for generally any type of bag-in-container system. An example of other useable systems are wine-in-box containers.

Referring to FIGS. 15–24, further embodiments of the present invention are illustrated. A flexible bag 200 includes a product portion 202 and an internal bladder portion 204. The product portion 202 includes a fitment shown generally at 206. The fitment 206 has three parts: a spout 208, a valve 210 having a check valve therein, and a cap 212. A tube 214 and a gas pressure valve 216 such as a check valve are connected to the internal bladder portion 204.

The bag 200 is positioned in the container 104, and the valve 210 and cap 212 are removed from the spout 208. The product portion 202 is filled with a flowable product such as the particulate-containing liquid products discussed above, and the valve 210 and cap 212 are then reattached to the spout 208. The internal bladder portion 204 is then expanded to displace the liquid product, wherein the displacement of the liquid product expands the flexible bag 200 to minimize or eliminate the wrinkling and/or folds of the bag 200. The internal bladder portion 204 may be inflated by injecting a pressurized gas via the tubing 214 and closing the gas pressure valve 216 when the internal bladder portion 204 is adequately filled. Among the advantages of expanding or inflating the bag 200 with a separate bladder portion is that the pressurized gas is isolated from the liquid product. This feature is particularly desireable where introduction of a gas may Contaminate the liquid product (i.e. aseptic applications), where introduction of a gas may oxidize the liquid product, where gas permeable containers are used, where it is preferable to use a less costly gas such as compressed air, or any combination of these requirements. The container 104 is illustrated as a fifty-five gallon steel drum having a body member 106 and a lid 132. However, it is noted that any type of container may be used. As discussed previously, the lid 132 is secured to the body member 106 in a conventional manner using a lid ring 138 and gasket 134.

The pressurized gas can be injected into the inner bladder portion 204 either before the lid 132 has been sealed onto the body member 106 or after it has been sealed onto the body member 106. Referring back to FIGS. 15–20, the gas pressure valve 216 can be provided to extend out through the lid 132 and can be attached to a gas pressure source 210. The gas pressure source 210 may be a motorized air compressor, a hand operated air pump, a gas bottle, a chemical reagent gas generator, or any other device capable of delivering pressurized gas. When the inner bladder portion 204 is filled with the pressurized gas with the lid 132 sealed to the body member 106, a vacuum/vent valve 218 for releasing pressure in the container 104 may be provided. The vacuum/vent valve 218 may be attached to the lid 132 and may be either automatically or manually actuable. If desired, the vacuum/vent valve 218 may be used to create a vacuum in the container 104 in conjunction with injecting a pressurized gas into the internal bladder portion 204.

Alternatively, the internal bladder portion 204 can be filled with pressurized gas before the lid 132 is attached to the body member 106 as shown in FIGS. 21–24. In this embodiment, the gas pressure valve 216 may be attached to the internal bladder portion 204 such that the valve 216 is situated within the container 104 when the lid 132 is secured. During the filling of the inner bladder portion 204, the gas pressure source 210 is coupled to either the gas pressure valve 216 or the tube 214. After the desired amount of gas has been injected into the internal bladder portion 204, the gas pressure valve 216 is closed. The lid 132 is then secured to the body member 106. If it is difficult to force the lid 132 onto the body member 106, a vacuum/vent valve 218 can be provided to release the pressure in the container 104 and surrounding the bag 200. Furthermore, the vacuum/vent valve 218 may be used to create a vacuum in the container 104 in conjunction with introducing pressurized gas into the inner bladder portion 204.

The flexible bag 200 can be generally any type which is commercially available including single ply made of nylon and ethylene vinyl alcohol co-extrusion or complex polyethylene mixture or a polyethylene-polyester-polyethylene laminate construction. The fitment 206 is preferably formed from a material and construction to enable attachment by heat sealing. For example, the fitment 206 can be made of plastic such as polyethylene. In addition, the flexible bag 200 can have a volume slightly larger than the volume of the container 104 so that it entirely fills the container 104 when expanded. The presence of small wrinkles and/or folds in the bag material should not lead to flex cracking because the bag material remains relatively fixed within the container 104. Alternatively, the volume of the bag 200 may be slightly smaller than the container 104 such that the bag 200 remains taught when expanded.

Referring to FIGS. 25–34, still further embodiments of present invention are illustrated. A flexible bag 250 includes a product portion 252 and an external bladder portion 254. The product portion 252 includes a fitment 255 having a spout 256, a valve 258 and a cap 260. A gas pressure valve 261 such as a check valve is coupled to the external bladder portion 254 by a tube 263.

The flexible bag 250 is positioned in the container 104 wherein the product portion 252 is filled with a flowable product such as the particulate-containing liquid products discussed above. The external bladder portion 254 is then expanded to minimize or eliminate the wrinkling and/or folding of the bag 250. The flexible bag 250 may have a volume slightly larger than the volume of the container 104 so that the flexible bag 250 abuts the inner walls of the body member 106 and remains substantially fixed relative to the container 104 in order to prevent flex cracking. In particular, the flexible bag 250 may abut the lower and sidewalls of the body member 106 and the bottom surface of the lid 132. It is noted that flexible bag 250 may have a volume smaller than the container 104 as long as the flexible bag 250 is dimensioned adequately to either abut the sidewall of the container 104 or abut the lower wall of the container 104 and the bottom surface of the lid 132 such that the flexible bag 250 remains substantially fixed relative to the container in order to prevent flex cracking.

The external bladder portion 254 may be inflated by injecting a pressurized gas via the valve 261 and closing the valve 261 when the external bladder portion 254 is properly filled. Among the advantages of expanding the flexible bag 250 with a separate bladder portion 254 is that the pressurized gas is isolated from the product. Several applications were such a feature may be required is discussed with respect to the embodiment illustrated in FIGS. 15–24. The container 104 may be a fifty-five gallon steel drum having a body member 106 and a lid 132. The lid 132 is secured to the body member 106 in a conventional manner using a lid ring 138 and gasket 134.

The pressurized gas can be injected into the external bladder portion 254 either before the lid 132 has been sealed onto the body member 106 or after it has been sealed onto the body member 106. Referring back to FIGS. 27–30, the gas pressure valve 261 can be provided to extend out through the lid 132 and can be attached to a gas pressure source 263 by a tube 265. The gas pressure source 263 may be a motorized air compressor, a hand operated air pump, a gas bottle, a chemical reagent gas generator, or any other device capable of delivering pressurized gas. When the external bladder portion 254 is filled with the pressurized gas with the lid 132 sealed to the body member 106, a vacuum/vent valve 267 for releasing pressure in the container 104 may be provided. The vacuum/vent valve 267 may be attached to the lid 132 and may be either automatically or manually actuable. If desired, the vacuum/vent valve 267 may be used to create a vacuum in the container 104 in conjunction with injecting pressurized gas into the external bladder portion 254.

Alternatively, the external bladder portion 254 can be filled with pressurized gas before the lid 132 is attached to the body member 106 as shown in FIGS. 31–34. In this embodiment, the gas pressure valve 261 may be coupled to the bag such that the valve 261 is situated within the container 104 when the lid 132 is secured. During the filling of the external bladder portion 254, the gas pressure source 263 is connected to the gas pressure valve 261. After the desired amount of gas has been injected into the external bladder portion 254, the valve 261 is closed and the lid 132 is then secured to the body member 106. If it is difficult to force the lid 132 onto the body member 106, a vacuum/vent valve 267 can be provided to release the pressure in the container 104 and surrounding the bag 250. Furthermore, the vacuum/vent valve 267 may be used to create a vacuum in the container 104 in conjunction with introducing a pressurized gas into the external bladder portion 254.

Referring to FIGS. 35–44, still further embodiments of the present invention are illustrated, wherein the bladder portion is integrally formed with the product portion. A flexible bag 300 includes two preferably rectangular sheets of plastic which form first 302 and second walls 304. The sheets are secured together about their perimeters by a first seal 308 to define therebetween an enclosure. A second seal is provided to define the enclosure into a product portion 312 and a bladder portion 314. In the embodiment shown in FIG. 35A, the second seal 309, extends from one side of the flexible bag 300 to an opposite side of the flexible bag 300. In the embodiment shown in FIG. 35B, the second seal 310 is L-shaped and extends from one side of the flexible bag to an adjacent side of the flexible bag. The product portion 312 contains the liquid product while the bladder portion 314 minimizes or eliminates wrinkling and/or folding of the flexible bag 300 when inflated. The sheets can be secured together by heat sealing, impulsed sealing, radio frequency RF) sealing, or other techniques as would be apparent to those skilled in the art. The product portion 312 has a through-hole and a fitment shown generally at 316, and the fitment 316 has three parts: a spout 318, a valve 320 having a check valve therein, and a cap 322. The bladder portion 314 includes a tube 324 and a gas pressure valve 326 such as a check valve.

Referring back to FIG. 35B, the flexible bag 300 is provided with a safety channel 328 having a first opening 330 at one end and a second opening 332 at the other end. In this embodiment, the sheets are not secured together continuously about their perimeters by the first seal 308. In particular, the first seal 308 does not extend continuously along the perimeter of the sheets in the region between the second seal 310 and a third seal 328 to form the openings 330, 332. Thus, the pressurized gas in the bladder portion 314 may be channeled outwardly through the openings 330, 332 rather than being directed into the product during failure of the second seal 310.

Figure 35B:
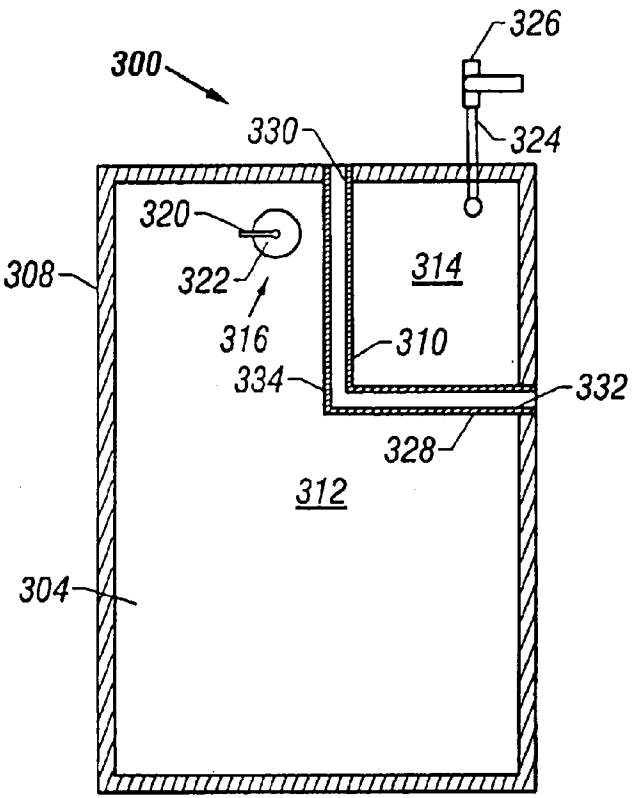
FIGS. 35A and 35B are side elevational views of alternative embodiments of flexible bags of the present invention.
Figure 35A:
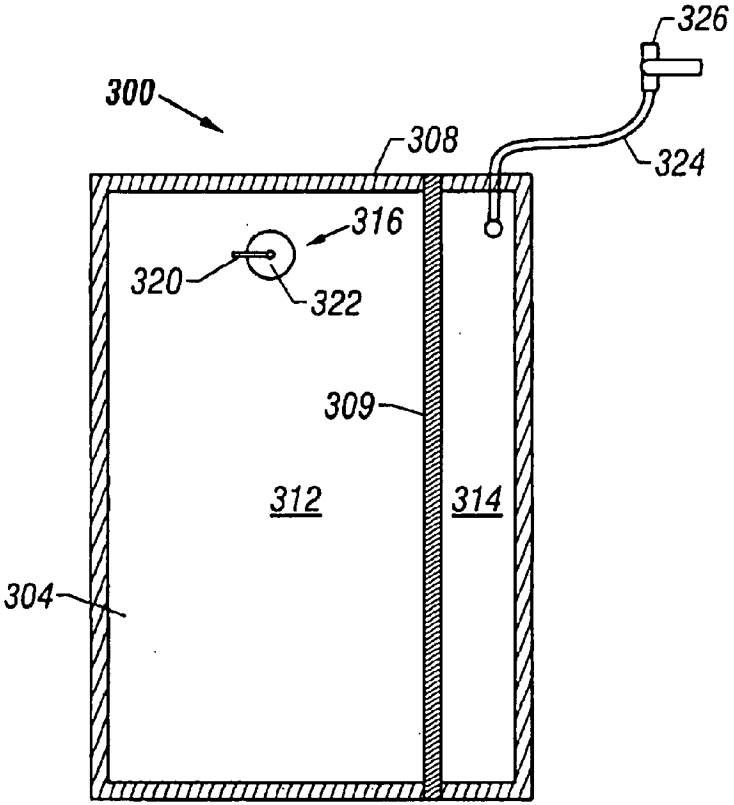
Figure 37:
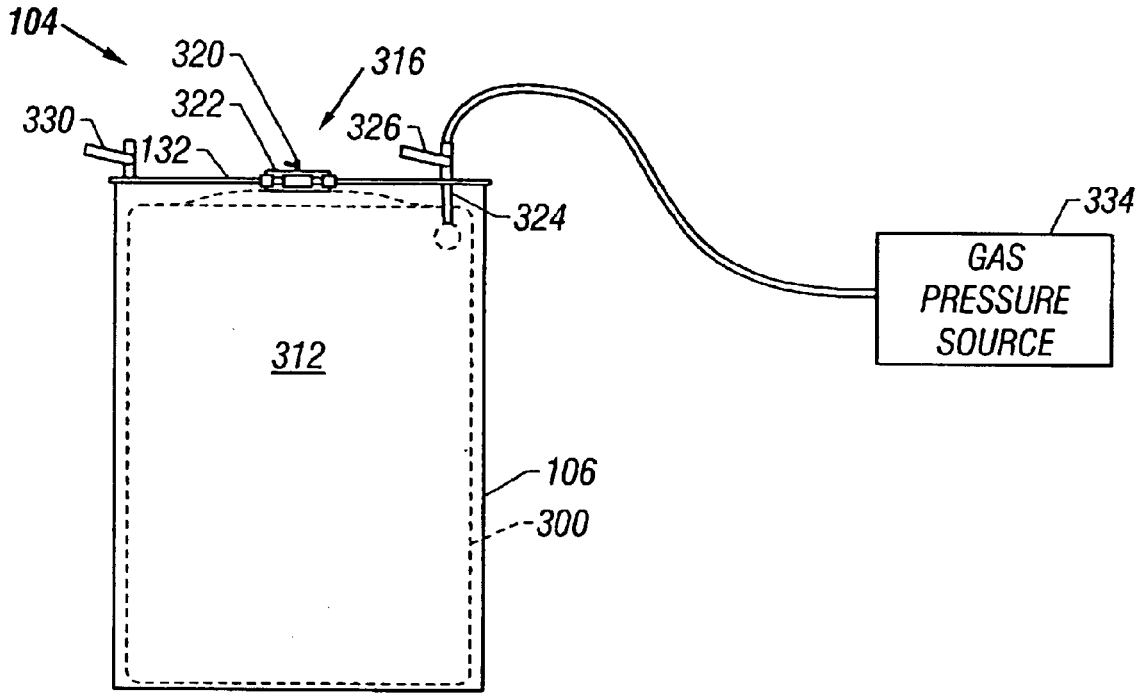
FIG. 37 is a side elevational view of a storage and transport system of FIGS. 35A and 35B.
Figure 38:
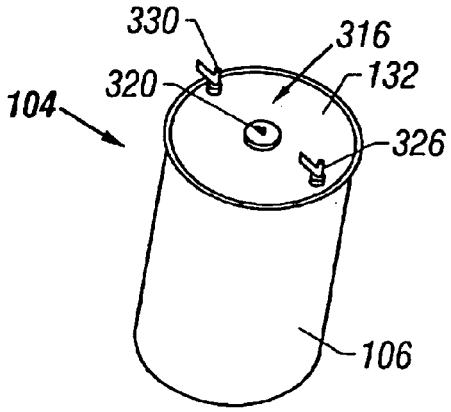
FIG. 38 is a top perspective view of the bag-in-container assembly of the system of FIGS. 35A and 35B.
Figure 39:
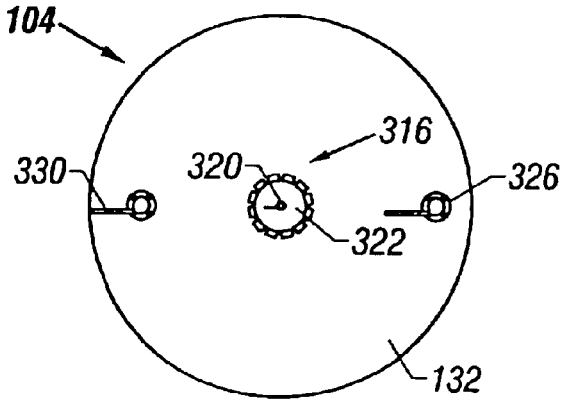
FIG. 39 is an enlarged top plan view of the assembly of FIG. 38.
Figure 40:
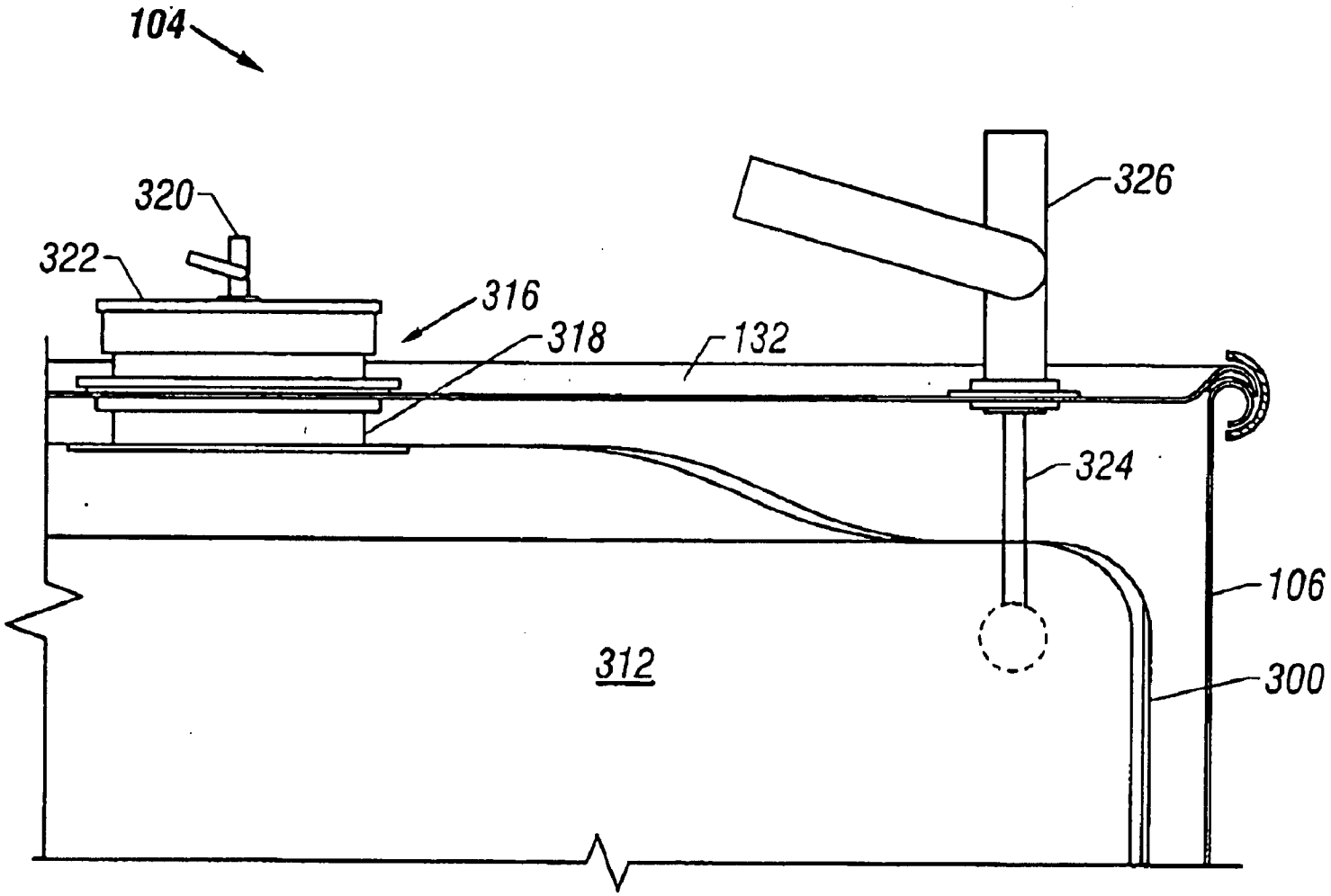
FIG. 40 is an enlarged elevational view of the upper right corner of the assembly of the system of FIG. 38.
Figure 41:
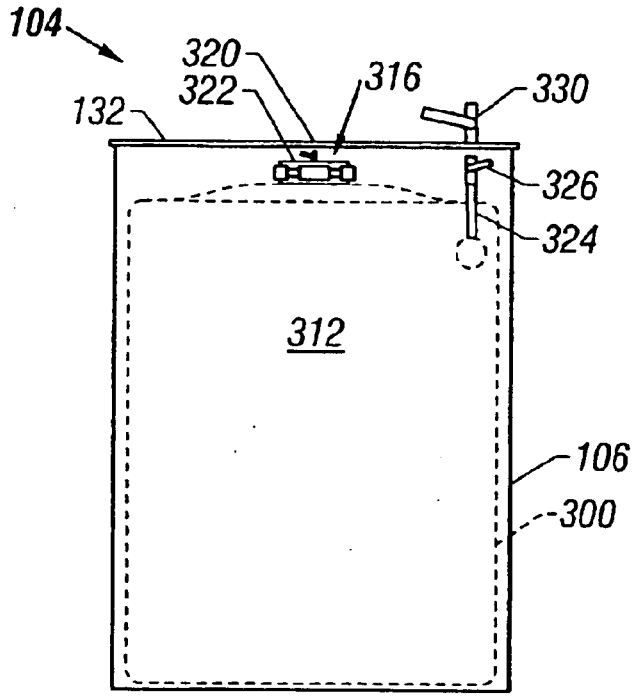
FIG. 41 is a side elevational view of an alternative storage and transport system of FIGS. 35A and 35B.
Figure 42:
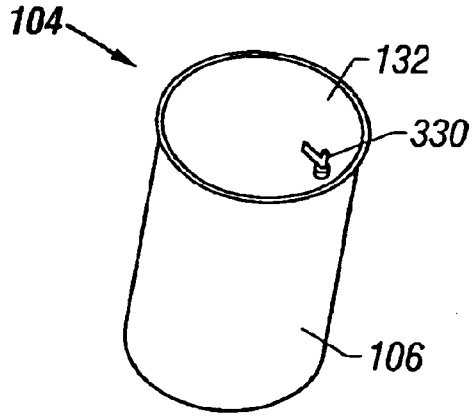
FIG. 42 is a top perspective view of the bag-in-container assembly of the system of FIG. 41.
Figure 43:
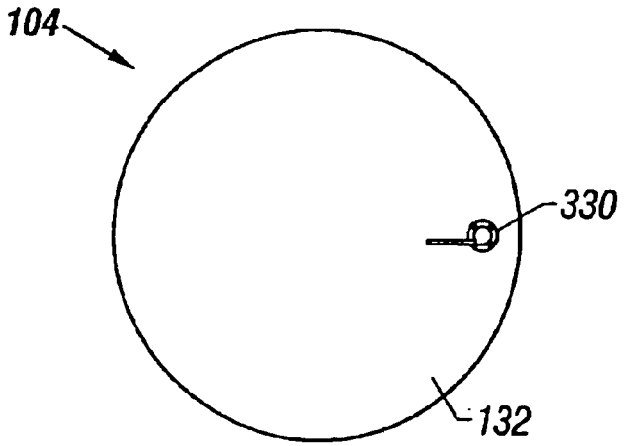
FIG. 43 is a top plan view of the assembly of FIG. 42.
Figure 44:
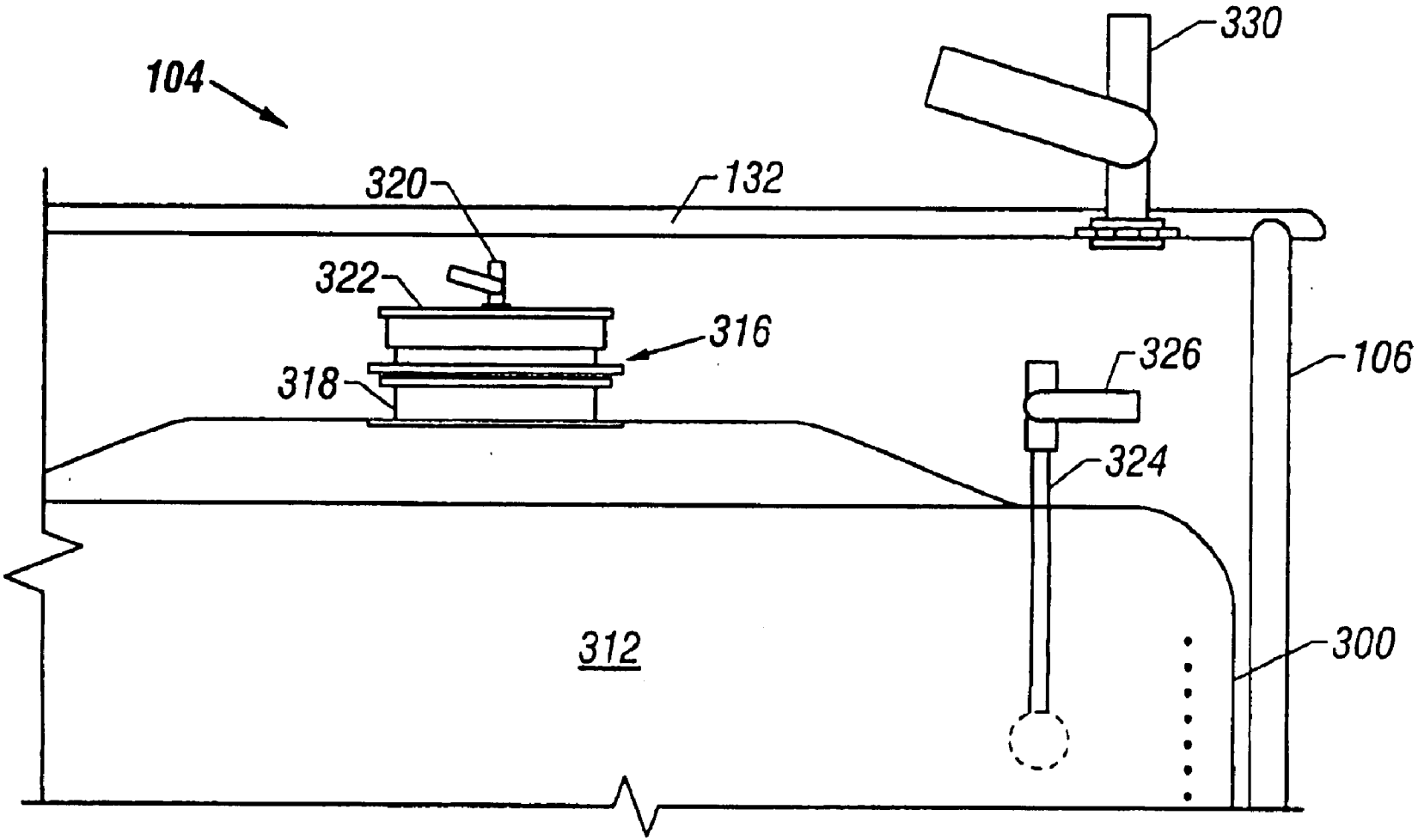
FIG. 44 is an enlarged view of the top right portion of the assembly of FIG. 42.

It is noted that the embodiment illustrated in FIG. 35A may also include a safety channel if desired. Furthermore, the openings of the channel may be formed by other means generally known to one skilled in the art. For example, instead of forming a discontinuous perimeter seal along the sheets, holes may be punched through the sheets to form exit openings along the channel. Furthermore, the bladder portion may be configured in various configurations by simply altering the patterning of the seal dividing the product portion from the bladder portion. For example, the seal may extend transversely to the longitudinal axis of the flexible bag to form a bladder portion which extends along an upper portion of the bag or the seal may extend longitudinally to the bag to form a triangular shaped bladder portion.

The flexible bag 300 may be filled in accordance with the following procedure. The flexible bag 300 is positioned in the container 104. The container 104 is illustrated as a fifty-five gallon steel drum having a body member 106 and a lid 132. As noted previously, the present embodiment is not limited to steel drums. The lid 132 is securable to the body member 106 in a conventional manner using a lid ring 138 and gasket 134. The valve 320 and cap 322 are removed from the spout 318. The product portion 312 is filled with a flowable product such as the particulate-containing liquid products discussed above, and the valve 320 and cap 322 are then reattached to the spout 318. The bladder portion 314 is then expanded to minimize or eliminate the wrinkling and/or folding of the flexible bag 300 by injecting a pressurized gas via the tube 324. When the bladder portion 312 is adequately filled, the gas pressure valve 326 is closed. As discussed previously, one of the advantages of providing a separate bladder portion is that the pressurized gas is isolated from the liquid product.

The pressurized gas can be injected into bladder portion 314 either before the lid 132 has been sealed onto the body member 106 or after it has been sealed onto the body member 106. The gas pressure valve 326 can be provided to extend out through the lid 132 and can be attached to a gas pressure source 334. The gas pressure source 334 may be a motorized air compressor, a hand operated air pump, a gas bottle, a chemical reagent gas generator, or any other device capable of delivering pressurized gas. When the bladder portion 314 is filled with the pressurized gas with the lid 132 sealed to the body member 106, a vacuum/vent valve 330 for releasing pressure in the container 104 may be provided as shown in FIGS. 37–40. The vacuum/vent valve 330 may be attached to the lid 132 and may be either automatically or manually actuable. Furthermore, the vacuum/vent valve 330 may be used to create a vacuum in the container 104 in conjunction with injecting pressurized gas into the bladder portion 314.

Alternatively, the bladder portion 314 can be filled with pressurized gas before the lid 132 is attached to the body member 106 as shown in FIGS. 41–44. In this embodiment, the gas pressure valve 326 may be attached to the bladder portion 314 such that valve 326 is situated within the container 104 when the lid 132 is secured. During the filling of the bladder portion 314, the gas pressure source 334 can be coupled to the gas pressure valve 326. After the desired amount of pressurized gas has been injected into the bladder portion 314, the gas pressure valve 326 is closed and the lid 132 is secured to the body member 106. If it is difficult to force the lid 132 onto the body member 106, a vacuum/vent valve 330 can be provided to release the pressure in the container 104 and surrounding the bag 300. Furthermore, the vacuum/vent valve 330 may be used to create a vacuum in the container 104 and surrounding the bag 300 in conjunction with introducing pressurized gas into the bladder portion 314.

The flexible bag 300 can be generally any type which is commercially available including single ply made of nylon and ethylene vinyl alcohol co-extrusion or complex polyethylene mixture or a polyethylene-polyester-polyethylene laminate construction. The fitment 316 is preferably formed from a material and construction such as polyethylene to enable attachment via heat sealing. The volume of the flexible bag 300 may be slightly larger than the volume of the container 104 so that it may abut the walls of the container 104 when expanded and remain relatively fixed with respect to the container 104. Alternatively, the volume of the flexible bag 300 may be slightly smaller than the volume of the container 104. However, the flexible bag 300 should be dimensioned such it remains taught when expanded. For example, the flexible bag 300 can be dimensioned to either abut the sidewalls of the container 104 or abut the lower wall of the container 104 and the bottom surface of the lid 132.

From the foregoing detailed description, it will be evident that there are a number of changes, adaptations and modifications of the present invention which come within the province of those skilled in the art. However, it is intended that all such variations not departing from the spirit of the invention be considered as within the scope thereof.

What is claimed is:

1. A method of reducing damage to a transportable flexible bag comprising:

placing a flexible bag into a substantially rigid container, said container having a removable cover;

introducing a flowable product into said flexible bag;

sealing said flexible bag so as to preclude the egress of material therefrom;

placing said cover onto said container, to, in turn, seal the container;

creating a vacuum inside said container and outside said flexible bag after sealing of said flexible bag and sealing of said container so as to substantially fix said flexible bag in a substantially rigid configuration relative to said container; and maintaining said flexible bag in said substantially rigid configuration during transportation of said container.

2. A method according to claim 1, wherein maintaining said flexible bag in said substantially rigid configuration includes adhering said flexible bag to said cover during the creating of said vacuum inside said container and outside said flexible bag.

3. A method according to claim 2, wherein the adhering of said flexible bag to said cover is preceded by applying an adhesive to an inside surface of said cover.

4. A method according to claim 1, wherein the maintaining of said flexible bag in said substantially rigid configuration includes maintaining a vacuum inside said container of about twenty inches of mercury.

5. A method according to claim 1, wherein a gas is introduced into said flexible bag prior to creating said vacuum inside said container.

6. A method according to claim 1, wherein a gas is introduced into said flexible bag simultaneous to creating said vacuum inside said container.

7. A method of substantially eliminating creases and folds in a bag during transport of said bag comprising:

providing a flexible bag;

placing said flexible bag in a container;

introducing a flowable product into said flexible bag;

sealing said flexible bag so as to preclude the egress of material therefrom;

sealing said container;

creating a vacuum on the inside of said container and outside of said flexible bag after sealing of said flexible bag and sealing of said container such that said flexible bag substantially abuts the container, to, in turn, become a skin on an inside surface of said container;

maintaining said flexible bag as a skin on said inside surface of said container during transport such that said flexible bag substantially maintains abutment when said flowable product is caused to move during said transport.

8. A method according to claim 7, wherein the maintaining of said flexible bag as a skin on an inside surface of said container includes adhering said flexible bag on said inside surface.

9. A method according to claim 8, wherein prior to the adhering of said flexible bag to said inside surface of said container includes applying an adhesive to said inside surface of said container.

10. A method according to claim 7, wherein the maintaining of said flexible bag as a skin on an inside surface of said container includes the holding of a vacuum on the inside of said container and outside of said flexible bag.

11. A method according to claim 10, wherein the maintaining of said flexible bag as a skin on an inside surface of said container, includes holding the vacuum at about twenty inches of mercury.

12. A method according to claim 7, wherein a gas is introduced into said flexible bag prior to creating said vacuum inside said container.

13. A method according to claim 7, wherein a gas is introduced into said flexible bag simultaneous to creating said vacuum inside said container.

14. A method for increasing the avoidance of stress cracks in a transportable flexible bag comprising;

providing a flexible bag;

placing said flexible bag in a substantially rigid container;

filling said flexible bag with a product;

sealing said flexible bag so as to preclude the egress of material therefrom;

covering said substantially rigid container;

creating a vacuum on the inside of said substantially rigid container and on the outside of the flexible bag after sealing of said flexible bag and covering said substantially rigid container; and, locking said flexible bag against an internal surface of said substantially rigid container such that said flexible bag is substantially prevented from movement during transport thereof.

15. A method as set forth in claim 14, wherein a gas is introduced into said flexible bag at substantially the same time as applying a vacuum on the inside of said substantially rigid container.

16. A method as set forth in claim 14, wherein a gas is introduced into said flexible bag prior to applying a vacuum on the inside of said substantially rigid container.

17. A method as set forth in claim 14, wherein locking of said flexible bag against an internal surface of said substantially rigid container includes adhering said flexible bag to said internal surface.

18. A method as set forth in claim 17, wherein prior to adhering said flexible bag to said internal surface of said substantially rigid container, an adhesive is applied to said internal surface of said substantially rigid container.

19. A method as set forth in claim 14, wherein locking said flexible bag against an internal surface of said substantially rigid container includes drawing a vacuum of about twenty inches of mercury on said substantially rigid container.

* * * * *